US005341717A

United States Patent [19]

Feldman

[11] Patent Number: 5,341,717

[45] Date of Patent: Aug. 30, 1994

[54] TOLERANCE COMPENSATING ASSEMBLY/POSITIONING SYSTEM AND METHOD OF USE

[76] Inventor: Richard L. Feldman, 10350 N. 142nd, Waverly, Nebr. 68462

[21] Appl. No.: 56,864

[22] Filed: May 5, 1993

[51] Int. Cl.[5] ..... F42B 33/04

[52] U.S. Cl. ..... 86/32; 86/36; 86/37; 86/24; 269/37; 269/58

[58] Field of Search ..... 86/32, 36, 37, 24, 28; 269/37, 55, 58, 71

[56] References Cited

U.S. PATENT DOCUMENTS

| | | | |
|---|---|---|---|
| 3,313,201 | 4/1967 | Lawrence | 86/32 |
| 3,636,812 | 1/1972 | Nuler | 86/33 |
| 4,289,258 | 9/1981 | Ransom | 86/33 |
| 4,522,102 | 6/1985 | Pickens | 86/27 |
| 5,025,706 | 6/1991 | Marble | 86/37 |

FOREIGN PATENT DOCUMENTS 2188130 9/1987 United Kingdom .

*Primary Examiner*—J. Woodrow Eldred
*Attorney, Agent, or Firm*—James D. Welch

[57] ABSTRACT

The present invention is an assembly/positioning system and method of use for application in the insertion or placement of tolerance dimensioned first process elements in tolerance dimensioned holes in or with respect to surfaces of second process elements. The system safely, precisely, repeatably and consistently compensates for tolerances in dimensions of process elements assembled therein, and for internal assembly/positioning system element tolerances which result from system stresses or temperature effects etc. during use. The assembly/positioning system also allows positioning process elements for processing and can include process element processing means internally. The assembly/positioning system utilizes mechanical or hydraulic toggle, insertion and tolerance compensation means in conjunction with mechanical transfer means to allow use with any combination of relatively large toleranced process elements. The assembly/positioning system provides a user simultaneous and totally independent control of both insertional and gauging forces. Multiple transfer, toggle, insertion and tolerance compensating means can be simultaneously but independently operated from a single control system. The method of use does not require a shut height depth set-up or require a practitioner to develop a "feel", read or set dials or repeatedly handle toleranced dimension process elements assembled within the system, or to have any ability beyond that which allows following a set procedure.

30 Claims, 10 Drawing Sheets

TOLERANCE COMPENSATING ASSEMBLY/POSITIONING SYSTEM AND METHOD OF USE

TECHNICAL FIELD

The present invention relates to systems and methods of use for assembling tolerance dimensioned process elements into assembled systems. More particularly the present invention relates to a tolerance compensating assembly/positioning system for use in a method of safely, precisely, repeatably and consistently inserting, for instance, tolerance dimensioned first process elements into tolerance dimensioned holes in second process elements; which assembly/positioning system simultaneously and automatically compensates for tolerances in both internal assembly/positioning system elements and in process elements during use, which assembly/positioning system provides sufficient insertional force necessary to accomplish assembly/positioning of said tolerance dimensioned process elements and simultaneously allows for a separate gauging force, controlled completely independently of the insertion force, at abutted surface contact points between first and second tolerance dimensioned process elements assembled in said assembly/positioning system; which assembly/-positioning system also allows positioning a process element for processing; and which method of use requires no special abilities on the part of a user other than the ability to follow a fixed set of instructions.

BACKGROUND

Assembly line production of assembled systems requires that the process elements comprising the assembled systems be interchangable. That is, for instance, if process elements "X" and "Y" are designed to be interconnected in an assembled system, any of a multiplicity of process elements "X" must be interconnectable to, with or in etc. any of a multiplicity of process elements "Y". The interchangeability of process elements is the basis of the economy of the assembly/positioning line approach to manufacturing and also makes field maintenance of assembled systems relatively easy. It is a fact of any manufacturing process, however, that process elements can not be manufactured to absolutely exact design dimensions. That is, tolerances in corresponding dimensions in a multiplicity of said process elements will exist. The presence of tolerances in process elements, it should be appreciated, can not be avoided and said tolerances are the cause of many problems during the process of assembling said tolerance dimensioned process elements into systems. Engineers are constantly concerned with the overall quality, form, fit and function of system process elements and assembled systems, and are guided toward achieving desired results by a system termed "tolerancing". Put simply, manufactured system process elements are deemed acceptable when their dimensions fall within a specified range.

It should be understood that there are basically three goals associated with the assembly or positioning of process elements. These goals can be demonstrated using toleranced length first process element and toleranced depth holes in second process elements as examples. The first goal is that toleranced length first process elements should be safely, repeatably, precisely and consistantly positionable with respect to, and/or inserted into, toleranced depth holes in second process elements. Second, precise control of gauging force between abutted ends of toleranced length first process elements and second process elements should be possible. (Note that the term "gauging force" refers to the force present between two process elements at their abutted point(s) of contact, when said process elements are assembled into a system. It is the result of the pressure of contact over the area of said abuttment between said process elements). The third goal is that goals one an two should be achievable regardless of variations in lengths, depths and outer and inner dimensions of toleranced length first process elements and toleranced depth holes in second process element. That is, sufficient "insertional forces" must be available and gauging forces should be controllable independently of required insertional forces. (It is noted that "insertional" forces are those required to force one process element into a system with a second process element).

One acceptable approach under the system of tolerancing is to require that tolerances in the process elements involved be kept very tight, (i.e.. small). Such "over-tolerancing" in the manufacturing process typically involves quality control selection of acceptably dimensioned process elements and rejection of process elements which emerge from the manufacturing process "out-of-tolerance". As a result a large amount of waste is involved, both in man-hours and in materials, when this approach is adopted, and the costs involved can quickly become prohibitive.

Another approach to overcomming the problems involved in the assembly and/or positioning of tolerance dimensioned process elements into systems or with respect to one another is to utilize machines which facilitate the assembly and/or positioning process such that larger tolerances in process element dimensions become acceptable. Machines utilized under this approach typically fall into one of two categories.

The first category is that demonstrated by fixed stroke length machines which provide a variable process element "gauging force", such as fixed "shut height" gauging force uncompensated presses. (Note the term "shut height" refers to the minimum distance achieved between the end of a stroking piston and a fixed base during a stroking cycle and is typically set by a user). As the name implies, these machines cycle a fixed displacement every stroke. A typical machine of this type is commonly known as a "punch press". A punch press typically comprises a rigid frame formed to resemble the letter "C". The upper portion of the said frame is configured to provide a sliding means in which a "ram" or "piston" is slideably fitted so that it can travel perpendicular to the lower portion of the rigid frame, which can be termed the "base". It is noted that process elements are placed upon said base during use and said ram or piston can be operated to apply force to said process elements when so located. The ram or piston is connected to a crankshaft via an adjustable "connecting rod" which typically is also connected to an energy storing flywheel which, in turn, is typically powered by an electric motor. The capacity of the fixed stroke length machine is determined by the flywheel/-connecting rod combination in combination with the stroke length. As alluded to, fixed stroke length machines typically fix the location of the base with respect to the fixed stroke length piston and do not provide any force absorbing capability in either the base or piston systems thereof. That is, during a cycle of use, when the crankshaft is at bottom-dead-center (BDC), and the lower end of a ram or piston is at its shut height above said base, a low tolerance dimensioned process element present on said base can be subjected to a user determined force. Tolerances in the height of a process element, and in machine elements, however, which result from stresses or temperature changes for instance, can pose a real problems and it should be appreciated that careful adjustment of the shut height is required to accomodate worst case tolerances. Fixed stroke length machines are particularly relevant to assembly processes in which "insertional" forces are required and/or in which a fixed displacement stroke length is otherwise acceptable or required, but in which careful control of "gauging" forces between assembled system elements is not required. Fixed stroke length machines are particularly applicable, but not limited to use in the assembly of relatively strong and rugged tolerance dimensioned process elements, which assembly requires development of an insertional force sufficient to effectively overcome "insertional resistance". Insertional resistance exists, for instance, where a first process element outer dimension is not sufficiently smaller than the inner dimension of a hole in a second process element into which said first process element is to be inserted, to allow an essentially frictionless gravity feed insertion. The result of simply providing sufficient insertional force to said process elements to assemble them into a system is typically termed a "press-fit". While a press fit is sufficient in many situations, it must then be understood that the gauging force between the inserted end of a toleranced length first process element and the end of a toleranced depth hole in a second process element into which the toleranced length first process element is inserted can not be accurately controlled by a fixed stroke length machine, emphasis added. In that light it should be appreciated that in many cases fixed stroke length machines do not provide sufficient means for compensating for tolerances in lengths of process elements assembled therein, nor it is mentioned, do they provide means for compensating for tolerances which result from stresses developed during use in elements of the fixed stroke length machine per se. it is specifically noted that when tolerance dimensioned process elements to be assembled are relatively delicate and/or gauging forces between assembled tolerance dimensioned process elements are to be carefully controlled, use of a fixed stroke length machine without tolerance compensation capability is generally contra-indicated. It should also be appreciated that fixed stroke length machines can be dangerous to operate. For instance, a fixed stroke length machine configured to apply "X" tons of force at the end of a stroking piston, at a shut height above a fixed base on the order of a fraction of an inch, and which fixed stroke length provides space between said fixed base and said end of said stroking piston in said fixed stroke length machine at other times during a stroke cycle operation sufficient for an operator's hand to be inserted thereinto, can lead to serious operator injury. Additionally, placing a relatively non-compressable process element on said fixed base which is of a dimension larger than the effective shut height of a fixed stroke length machine can cause elements internal to a fixed stroke length machine to become stressed to the point of breaking in a violent manner when said process elementals subjected to pressing force by said fixed stroke length machine. In such a situation a fixed base might break, the fixed stroke piston might break or an energy containing rotating flywheel present in said fixed stroke length machine might snap free of an attaching shaft. As well, associated tooling and process elements can be damaged. Again, serious injury to an operator or to adjacent equipment etc. is a real possibility if fixed stroke machines are not carefully controlled by experienced personnel. It should also be noted that a fixed stroke length machine which does not include means for tolerance compensation of internal elements can incidiously, as a result of, for instance, thermal expansion of internal elements during use, become dangerous to operate without a user thereof making any adjustments thereto or otherwise suspecting a problem is developing.

The second category of machine is that demonstrated by variable stroke length machines which can provide variable tolerance dimensioned process element gauging pressures between abutted surfaces of process elements assembled therein during use. Variable stroke length machines can be envisioned as generally similar to fixed stroke length machines but in which, for instance, the base upon which a process element is positioned during use can move during use and thereby absorb some of the force applied to a tolerance dimension process element placed thereon, by a stroke piston. Force absorbing elements can also, or in the alternative, be placed in a stroking piston system of such variable stroke length machines. Machines in this category utilizing hydraulic or pneumatic cylinder type force absorbing means typically enable achieving an intended tolerance process element abutted surface gauging force, (which is the difference between applied force and required insertional force), even when a press-fit insertional force is required, but those utilizing "springs" typically enable effecting an intended tolerance process element gauging force between assembled process elements only when press-fit insertional force is relatively small. Hydraulic or pneumatic cylinder utilizing variable stroke length machines are capable of providing a fixed force over a relatively large stroke length, whereas spring utilizing variable stroke length machines provide a variable force over an effective stroke length. It is also noted that the piston in a varaible stroke length machine should never reach the end of its stroke during use, as a fixed stroke length configuration is then effected. Variable stroke length machines are particularly relevant to assembly or positioning of relatively delicate tolerance dimensioned process elements to which large forces can not be applied without ruining said tolerance dimensioned process elements, and/or in which a variable stroke length is otherwise appropriate to properly interconnect relevant tolerance dimensioned process elements. That is, such machines are particularly indicated when large tolerance dimensioned process element insertional forces are not required, or even tolerable, during an assembly or positioning process, but for instance, when relatively better control of assembled tolerance dimensioned process element gauging forces is required. (Note that when hydraulic or pneumatic cylinder type utilizing variable stroke machines are used a relatively large insertional force can also be simultaneously provided). Variable stroke length machines are, within limits, somewhat safer to operate than fixed stroke machines because of the force absorbing elements present therein, but they can still cause serious damage and/or injury when the limits of the force absorbing elements are exceeded. In addition typical variable stroke length machines are unable to fully compensate for tolerances which develop in internal elements thereof during use because of, for instance, heating or element stressing. As well, it is typically necessary to design custom variable stroke length machines for specific intended purposes. In this respect they are not superior to fixed stroke machines.

It should be appearant that operators of both fixed and variable length machines must have a thorough understanding of said machines and must have capabilities far in excess of those which allow the following of a fixed set of non-varying instructional steps.

An appropriate example to better clarify the foregoing is that involving the process of inserting of a toleranced length first process element into a mated toleranced depth hole in second process element, to form an assembled system. The goal of the process being that the end of toleranced length first process element inserted into the mated toleranced depth, (typically flat bottomed), hole in the second process element, be placed precisely and intimately in abutted contact with the end of said toleranced depth hole with an intended gauging force present at the point of contact. If the tolerances of the identified system process elements are such that the outer diameter, (assuming circular shaped toleranced length first process element and toleranced depth hole in said second process element), of the toleranced length first process element is always smaller than the inner diameter of the toleranced depth hole in the second process element, simple gravity feed might be sufficient to properly position said process elements with respect to one another and machine requirments would be reduced to positioning and transfering means. As well, a variable stroke machine utilizing springs might be utilized. If the tolerances of the outer diameter of the toleranced length first process element and the inner diameter of the toleranced depth hole in the second process element are such that an insertional force is required to cause the identified insertion, the first class of machine above, or a machine from the second class which utilizes hydraulic or pneumatic cylinders or strong springs would probably be indicated to cause a "press-fit". However, tolerances in the length of the first process element, and the depth of the hole in the second process element will not always be accommodated by the relatively fixed stroke length provided by either of said machines, and precise control of the gauging force between abutted surfaces of the assembled tolerance process elements will not repeatably and consistently result.

From the above it should be appearant that a fixed stroke length machine, with the capability of providing sufficiently large insertional forces to overcome tolerances in the relative diameters of first and second process elements as described above, but which would simultaneously independently effect precise and repeatable control of gauging force between assembled abutted ends of toleranced length first process elements and the ends of toleranced depth holes in second process elements when insertional forces are required, would be of great utility. However, even were a fixed stroke length machine, such as those described above, available which provided the identified superior attributes, (which it is not), as valuable as it would be, problems would still exist in that tolerances which occur in internal elements thereof would not be adequately compensated. As mentioned above such tolerances can result from stresses which develop during use, and from, for instance, the effect of thermal expansion etc. It should further be appreciated at this point, that a system which would simultaneously overcome all said identified problems and which would allow a user thereof to safely follow a set method of use without the requirement that a "feel" be relied upon to arrive at consistent repeatable optimum results would be of great utility.

A particularly relevant, but by no means limiting, use for such a machine would be to facilitate the safe, precise, repeatable and consistent loading of essentially cylindrical shaped toleranced diameter and length primers into essentially cylindrical shaped toleranced diameter and depth flat bottomed primer pocket holes in bullet shell casings in a manner which would not damage said primers or bullet shell casings and which would allow precise control of the gauging force between assembled primer and bullet shell casing systems while providing the insertional force required to form the assembled system. It has long been known that proper insertion of primers into mating bullet shell casing pockets can improve the flight of bullets fired therefrom. In cases wherein the primer is seated "short", (i.e. the primer anvil does not touch or make intimate contact with the bottom of its mating pocket in the cartridge case), a situation presents wherein lock-times are increased, (i.e. the total time it takes from the moment the trigger releases the firing pin until the detonation of the primer occurs). This results as the firing pin must drive the primer to its seat before enough energy can be exerted to cause detonation. This produces a "cushioning" effect which robs some of the available energy from the firing pin and reduces its effectiveness. In cases wherein the primer is seated "long", (i.e. seated too deep), a situation occurs where the primer anvil is forced into the explosive element of the primer causing it to crack or break up. Both situations can cause erratic ignitions of the primer and adversly effect the burning characteristics of the powder, and hence, the overall accuracy of a bullets flight due to changes in velocity. A search of the prior art in this area has shown that the problems associated with tolerances during assembly of primers and bullet cartridges has not been solved.

U.S. Pat. No. 5,025,706 to markle is perhaps the most relevant and describes a manually operated controlled depth primer seating tool and a multi-step method of use thereof. The Markle invention makes a significant step toward a solution to the problems identified above but falls short of meeting all of the identified criteria. While tolerances in both the depth of the primer pocket in a center fire cartridge and in the length of a primer inserted thereinto are meant to be compensated when a user follows a described method of use of said invention system, he or she must be capable of reading and setting a dial on a gauge when the system is configured with a primer entered to one portion of the invention system, and then said primer must be removed and placed into another portion of the invention system to allow its insertion into a primer pocket in a center fire cartridge. The required repeated handling of the primer is undesirable as it can lead to contamination thereof with body oils etc. Said contamination can lead to primer misfiring in use. In addition, the method of use of the invention requires that a user apply "overseating" forces, but provides no means by which a user can determine how much of said overseating force is necessary because of internal system tolerances which develop because of application of said overseating force, and how much of said overseating force actually appears as gauging force between assembled primers and cartridge primer seats. In addition, no means of compensating internal system tolerances is present. While it appears that the Markle invention works better than other inventions, (discussed directly), intended for similar purposes, and provides an advancement in the art, to practice the method of use described requires that a user be capable of taking readings from a dial, setting said dial, repeatably handle primers and cartridge cases and apply overseating forces which, in part, are necessary to overcome internal system tolerances. That is, a user can not simply follow a set procedure and consistently and repeatably arrive at optimum results, and the ability of a user appears to play heavily in successful use of the Markle invention system, as is the case regarding systems and methods found in other Patents. A system and method of use which would overcome the identified problems is therefore still needed.

U.S. Pat. No. 4,522,102 to Pickens describes a system which allows a user to tend to automatically remove spent primers from cartridges, admit powder into cartridges, introduce and insert bullets into cartridges, crimp and seal said bullets into said cartridges and insert and introduce new primers into said cartridges. The primer insertion portion of the system appears to utilize a variable length stroke non-spring compensated approach to properly mate said primer into said cartridge. This requires a user controlled "feel" over the gauging force between a cartridge primer pocket and a primer inserted thereinto.

U.S. Pat. No. 3,313,201 to Lawrence describes a fixed stroke length system for inserting primers into a cartridge case which uses the face of a cartridge to act as a gauging point of reference, thereby compensating for tolerances in rim depths. However, shrinkage in the primer compounds and tolerances in the lengths of primers and of cartridge pockets are not compensated, and no means by which a user can control gauging force are present.

U.S. Pat. No. 3,636,812 to Nuler describes a tool system which allows adjustment of the depth a fixed stroke length punch system will insert a primer into primer pocket of a cartridge case. The tool system is hand held and operated by a user by an action consisting of squeezing a handle toward the body of the tool system. Said user action causes, via a linkage mechanism, a primer to be pressed into said primer pocket. Said tool system provides a fixed stroke length but provides an adjustment to the shut height which allows achieving an effective variable stroke length result. It is not clear, however, how a user will know how to perform said adjustment to achieve an optimum end result without measuring each primer length and primer pocket depth individually. Again means by which a user can adjust gauging force are not present.

United Kingdom Patent No. GB 2,188,130 to Hans describes another system for seating primers into cartridge cases which appears to utilize a fixed stroke system approach which also provides an adjustment to the shut height which allows achieving an effective variable stroke length result. It is again unclear how a user will know how to set the device to achieve an optimum end result, as noted with respect to the Nuler invention. Again, means by which a user can adjust gauging force are not present.

Finally, U.S. Pat. No. 4,289,258 to Ransom describes a safety charge measuring device for cartridge loading machines. Said system includes a sliding charge receiver which allows positioning a charge receiving hole therein under a powder receiving hole to allow loading powder thereinto, and which also allows subsequent positioning of said powder loaded charge receiving hole over powder feed chute to deliver it into a bullet cartridge.

It should, in view of the foregoing, be appreciated that the precise loading of toleranced length first process elements, (such as primers), into toleranced depth holes in second process elements, (such as primer pockets in bullet shell casings), presents a difficult problem. While various inventors have struggled with the problem and provided various systems and methods of use aimed at solving it, a need still exists for a system and method of use which allows a user, with no other ability than to follow a set sequence of invariant steps, and without the need to develop and rely on a "feel", to safely, repeatably and consistently insert toleranced length first process elements into toleranced depth holes in second process such that a precise and intimate intended assembled system is easily and repeatably achieved with an intended gauging force present between abutted ends of said assembled elements. Such system and method should provide for development of sufficient insertional force consistent with completely independent control of an end point gauging force present between assembled process elements at their point of contact. In addition there should be no requirement of removal of a toleranced length first process element from said system after entered thereto, until it is precisely loaded into a toleranced depth hole in a second process element. Said system and method of use should automatically provide for compensation of tolerances in toleranced length first process elements and in toleranced depth holes in second process elements, as well as in internal system elements, (such as those resulting from stresses on internal system elements during use and thermal expansion etc.), without the need that a user read and set dials etc. or do anything other than follow a set sequence of definite steps. In addition, the system should be safe to use and should allow multiple such systems to be simultaneously used and controlled from a single control system without adverse interaction therebetween, even when greatly differing size process elements are being processed by different of said multiple systems and even if two process elements are not coplanar with each other. Such a system should allow simplification of quality control and manufacturing processes, eliminate waste, reduce manufacturing set-up times, provide higher quality assembled goods, save money by allowing use of large tolerance process elements and eliminate any need to pre-gauge or sort tolerance parts. In addition, such a system should be applicable to use in positioning process elements with respect to one another when insertion of one into another is not required to form a system, or when positioning of one process element to allow processing thereof is to be achieved.

The present invention meets the identified need.

DISCLOSURE OF THE INVENTION

The present invention system can be catagorized as an assembly/positioning system that is comprised of four sub-systems which are interconnected within a Basic Structure, said sub-systems being:

1. A Transfer Means
2. A Toggle Means;
3. An Insertion Means; and
3. A Tolerance Compensation Means;

of which the Toggle Means, in combination with the Tolerance Compensating Means are the functionally most important. To understand the functional importance of said sub-systems in the context of the present invention, however, it is necessary to understand the Basic Structure and Transfer Means.

In the following a relatively easily understood mechanical embodiment of the present invention is disclosed both structurally and functionally. Basic Structure, including the Transfer Means, of said relatively easily understood mechanical embodiment is described first to provide a basis for describing the more functionally important sub-systems of the present invention in the context of the present invention. Headings are provided in the following to aid identification of the sections hereof which describe the identified sub-systems of the present invention.

Basic Structure

In a relatively easily understood mechanical embodiment, the present invention is comprised of an elongated rigid frame, which elongated rigid frame presents with a longitudinal dimension that typically, although not necessarily, projects vertically from an underlying essentially horizontal surface during use. At the upper aspect of said elongated rigid frame, when so oriented, is a present the Transfer Means.

Transfer Means

The Transfer Means is, in the presently described relatively easily understood mechanical embodiment of the present invention, comprised of a shuttle bar slidably inserted into a horizontally oriented channel means at an upper extent of said rigid frame. Said shuttle bar has vertically oriented holes therethrough, a first of which vertically oriented holes can, during use, be positioned under a first upper vertically oriented hole which projects through the top of said rigid frame into said horizontally oriented channel means, by sliding said shuttle bar in said horizontally oriented channel means. When said first vertically oriented hole in said shuttle bar is so positioned a toleranced length first process element can be loaded thereinto through said first upper vertically oriented hole which projects through the top of said rigid frame into said horizontally oriented channel means. Once said toleranced length first process element is loaded into said first vertically oriented hole in said shuttle bar, said shuttle bar can be caused to slide in said horizontally oriented channel means such that a second upper vertically oriented hole which projects through the top of the rigid frame into said horizontally oriented channel means is aligned with a second vertically oriented hole through said shuttle bar. Said second upper vertically oriented hole through the top of said rigid frame can accommodate a second process element thereabove, which second process element has a toleranced depth hole therein for receiving said toleranced length first process element, and into which said toleranced length first process element, (then present in said first vertically oriented hole through said shuttle bar), is to be precisely inserted so that an intended gauge force is present at the contact point between the upper end of said first toleranced length process element and the end of the tolerenced depth hole in said second process element. When the shuttle bar is so positioned, the toleranced length first process element, it will be appreciated, will be under an upper gauging surface of said horizontally oriented channel means and the second vertically oriented hole in said shuttle bar will be present under the second upper vertically oriented hole through the top of said rigid frame. In alternate embodiments of the present invention the Transfer Means can comprise functionally equivalent conveyor belts or rotary transfer table etc. based systems. As well, the horizontally oriented channel means need not continuously surround said shuttle bar or functional equivalent, except that an upper gauging surface located as described is required.

Toggle Means

Continuing, the present invention further comprises Toggle Means. Said Toggle Means, in the presently described relatively easily understood mechanical embodiment of the present invention is comprised of first and second plungers which are present in first and second lower vertically oriented holes in said rigid frame, which first and second lower vertically oriented holes in said rigid frame are positioned so that they project into said horizontally oriented channel means from beneath said horizontally oriented channel means and so that the first of said plungers is present directly beneath said toleranced length first process element present in said first vertically oriented hole through said shuttle bar when said shuttle bar is positioned as described just above, and so that said second plunger is simultaneously present directly beneath said second upper vertically oriented hole through the top of said rigid frame, which second upper vertically oriented hole through said rigid frame serves to accommodate said second process element, into a toleranced depth hole in said second process element, said toleranced length first process element is to be precisely inserted as described above. Continuing, the lower ends of said first and second plungers are supported at opposite ends of an additional Toggle Means essentially horizontally oriented arm, said first plunger being supported by a first end of said essentially horizontally oriented arm, and said second plunger being supported by a second end of said essentially horizontally oriented arm, which essentially horizontally oriented arm is pivotally connected at a midpoint thereof to Insertion Means.

Insertion Means

The Insertion Means comprises a first link which is, at an upper end thereof pivotally connected to the midpoint of said essentially horizontally oriented arm, and at its lower end is pivotally connected to an upper end of a second link. A lower end of said second link is pivotally connected to the Tolerance Compensation Means. Said first and second links are sized to provide a desirable rotation arc and to provide the mechanical advantage necessary to insert toleranced length first process elements into toleranced depth holes in second process elements. In alternate embodiments, functionally equivalent hydraulic means, for instance, can replace the described Insertion and some elements of the Toggle Means. As well, said tolerance compensation means can be located at any functionally equivalent position such as at the upper end of either the first or second link etc.

Tolerance Compensation Means And Discussion

Said Tolerance Compensation Means is, in the presently described relatively easily understood mechanical embodiment of the present invention, comprised of an adjustment means for directly adjusting the vertical position of the lower end of said second link with respect to said rigid frame. Said adjustment means for directly adjusting the vertical position of the lower end of said second link with respect to said rigid frame is typically a wheel, which wheel has a threaded rod attached thereto, which threaded rod is screwed into and through a threaded hole in said rigid frame, with the upper end of said threaded rod being pivotally connected to the lower end of said second link. Rotation of said wheel causes the threaded rod to move vertically upward or downward with respect to the rigid frame depending on the direction of rotation thereof. This indirectly controls the effective shut height of the upper ends of the second and first plungers with respect to the upper surface of said horizontally oriented channel means, or first or second process elements etc. Said wheel will typically be of a type which will limit the amount of force which it can exert on the threaded rod, said limitation typically being achieved by a controlled slippage of said wheel with respect to said threaded rod when a certain applied force is present at the upper end of said threaded rod. It is also to be understood that the pivotal connection between the essentially horizontally oriented arm, which supports the lower ends of said second and first plungers, and the upper end of the first link, and the pivotal connection between the lower end of the second link and the upper end of the adjustment means for directly adjusting the vertical position of the lower end of the second link with respect to the rigid frame, can each be by means which include a means such as a rod, each of which rods projects into an associated slot in said rigid frame. (Note the pivotal connection between the lower end of said second link and the upper end of said tolerance compensation means adjustment means for directly adjusting the upper vertical position of the lower end of said second link is preferably by a cup present on the upper end of said adjustment means and a complimentary connection means present on the lower end of said second link, making a rod and slot unnecessary). Said configuration serves to keep said identified pivotal connections oriented vertically, one directly above the other, when the second link is caused to rotate about its pivotal connection with the upper end of the means for directly adjusting the vertical position of the lower end of the second link. Said rotation will simultaneously cause a rotation to occur between the pivotal connections between the upper end of the second link and the lower end of the first link, and between the upper end of the first link and the mid-point of the essentially horizontally oriented arm. The intended and resulting effect of said rotations being to provide effective vertical position adjustment of the upper ends of said first and second plungers by what is effectively a fixed stroke length, which fixed stroke length is effected by rotating the second link. Said fixed stroke length, however, is applied at a vertical position with respect to the rigid frame that is controlled by said Tolerance Compensation Means adjustment wheel which allows direct adjustment of the vertical position of the lower end of said second link with respect to the rigid frame. As a result an intended gauging force can be applied by the top ends of the second and first plungers to the vertically upper end of the toleranced depth hole in the second process element, the upper gauge surface of the horizontally oriented channel means, or the vertically upper end of the toleranced length first process element, as the case might be at a certain step in the method of use of the described system. In alternate embodiments functionally equivalent hydraulic means, for instance, can replace said first and second links, wheel and threaded rod.

With the relatively easily understood mechanical embodiment of the present invention system essentially described, attention now turns to the method of use thereof.

Method Of Use

During use, said wheel of the Tolerance Compensation Means is typically first adjusted so that the lower end of the second link is at its lowest possible level with respect to the rigid frame. Next, said second link is rotated to effectively position said second and first plungers so that the upper ends thereof are lowered so that neither projects into the horizontally oriented channel means or through a vertically oriented hole in said shuttle bar. With said shuttle bar then free to move, it is caused to slide so as to position said first vertically oriented hole therein under the first upper vertically oriented hole in the top of said rigid frame, through which first upper vertically oriented hole a toleranced length first process element is caused to enter said first vertically oriented hole in said shuttle bar. Next, said shuttle bar is caused to slide so that said second vertically oriented hole therein is oriented directly below said second upper vertically oriented hole in the top of said rigid frame. A second process element with a toleranced depth hole therein is accommodated at said second upper vertically oriented hole in the top of said rigid frame, thereabove. Next, the second link is rotated to its fullest extent so as to cause the upper ends of said first and second plungers to approach and possibly contact the lower end of the toleranced length first process element, and to approach and possibly enter the second vertically oriented hole in the shuttle bar and toleranced depth hole in said second process element, respectively. Next, said wheel of the Tolerance Compensation means is adjusted to remove any free space, and apply a desired gauging force between the upper end of the second plunger and the vertically upper end of the toleranced depth hole in the second process element, and between the top of said first plunger and the lower end of the toleranced length first process element present in said first vertically oriented hole in the shuttle bar, the upper end of which toleranced length first process element is flushly pressed against the upper gauging surface in the horizontally oriented channel means. Note that the essentially horizontally oriented arm will be rotated about its midpoint pivotal connection with the top of said first link, to an angle with respect to horizontal by this process. Said angle is determined by the length and depth of the toleranced first process element and the toleranced depth hole in the second process elements. Next, said second link of the Insertion Means is rotated so that the upper ends of the second and first plungers are vertically lowered to free said shuttle bar. Said shuttle bar of the Transfer Means is then caused to slide so as to position the first vertically oriented hole therein, (which still contains said toleranced length first process element), under said second upper vertically oriented hole in the top of said rigid frame. Note that the shuttle bar is designed so that when so positioned the upper end of said first plunger can extend through the horizontally oriented channel means in the rigid frame and contact the upper gauging surface of said horizontally oriented channel means. This can be effected by simply appropriately limiting the length of said shuttle bar, or by providing a third vertically oriented hole therethrough which orients directly above the first plunger when the shuttle bar is positioned as described. Next, said second link of the Insertion Means is rotated so that the upper ends of the second and first plungers contact the lower end of the toleranced length first process element and the upper gauging surface of the horizontally oriented channel means, respectively. The first toleranced length process element, it should be appearant, will then be precisely pushed into the toleranced depth hole in the second process element by said process, with the upper end thereof bein placed in abutted in flush intimate contact with the vertically upper end of the toleranced depth hole in said second process element. Said intimate contact will have associated with it an abutted surfaces gauging force that was determined when the Tolerance Compensation Means wheel was rotated to remove any space between the upper ends of the second and first plungers the lower end of the toleranced length first process element, (when its upper end was flush against the upper gauging surface of the horizontally oriented channel means), and the upper end oi the toleranced depth hole in the second process element respectively, as described above.

It should be appreciated that the above described method of use of the described system serves to provide a fixed stroke length system with an ability to provide a potentially large insertion force, but which also independently provides a desired abutted surfaces gauging force. That is, sufficient insertional force is available, simultaneous with an independent provision of an intended abutted surfaces gauging force between the upper end of the first toleranced length process element and the vertically upper end of the toleranced depth hole in said second process element. (This is made possible by the prior stressing of the toleranced process elements by the upper end of said first and second plungers, and of the present invention system elements, in the method described above). The effective variable stroke length and associated gauging force are effected by adjustment of the wheel of the Tolerance Compensation Means, which serves to directly adjust the vertical position of the lower end of the second link, and effectively, the vertical levels of the upper ends of the second and first plungers with respect to the rigid frame. The rotation of the essentially horizontally oriented arm which is pivotally connected to the upper end of the first link at its midpoint serves to cancel out tolerances associated with the toleranced length first process element length and the toleranced depth hole in the second process element when the above described method is practiced, as well as tolerances which develop in internal assembly/positioning system elements as a result of stresses during use and thermal expansion etc. Again, rotation of said essentially horizontally oriented arm effectively serves to cancel all tolerances. Toleranced process elements can then be safely, precisely, repeatably and consistantly assembled into combination systems by the present invention system and method of use in a manner which compensates for said tolerances, without any special ability required on the part of a user of the present invention, other than that of following a definite invariable sequence of well defined steps. It should also be appreciated that the present invention assembly/positioning system is relatively safe to use. If a user's appendage should become present between either of the two vertically oriented plungers and an upper gauging surface for instance, injury will be limited to that which the gauging force available at the top ends of said plunger can cause, which gauging force is limited to that effected by rotation of the wheel of the Tolerance Compensation Means. The dangers associated with use of fixed and even variable stroke length machines, as described in the Background Section, are thus greatly minimized.

A particularly relevant application for the described system and method of use, is in the positioning of toleranced length primers into toleranced depth holes in bullet shell casings, wherein said primer is the toleranced length first process element and the bullet shell casing, with a toleranced depth primer receiving hole therein, is the second process element. In said application it is found that the tolerances in the lengths of primers and in the depths of holes in bullet shell casings, which vary from primer to primer and form bullet shell casing to bullet shell casing, can be safely, precisely, repeatably and consistantly completely accommodated for by the present invention system and method of use. Without exception, primers will be placed with their upper ends flush against the vertically upper ends of the typically flat bottomed holes present in bullet shell casings by the present invention system, with an established associated intended gauging force present at the abutted point of contact therebetween, when the described method of use is followed.

It is also to be understood that the present invention can be used with the longitudinal dimension of the rigid frame projecting other than vertically. Spring elements which serve to keep the lower ends of said first and second plungers flush against their respective ends of the essentially horizontally oriented arm, while beneficial regardless of the orientation of the rigid frame, can be added to the system described above and are more relevant when the rigid frame is oriented other than with its longitudinal dimension oriented so as to project vertically. Said spring elements will typically circumscribe said second and first plungers and be present inside the second and first lower vertically oriented holes in the rigid frame. A vertical orientation of the longitudinal dimension of the rigid frame was utilized herein only to facilitate description.

It should also be appreciated that a seriesed sequence of systems as described, in which a shuttle bar movement in one of said systems causes simultaneous shuttle bar movement in the other systems, and in which the rotation of the second link in one system causes simultaneous rotation of the second links in the other systems etc. can be fashioned to allow multiple insertion of a multiplicity of first process elements into holes in second process elements simultaneously. Such a seriesed sequence of systems could simultaneously operate even if greatly different sized process elements were present in each, or even if one of said seriesed sequence had no process elements present therein. Such a seriesed sequence of systems would, it should be understood, require a user thereof to adjust each Tolerance Compensation Means Wheel separately to adjust for individual tolerances present in various combinations of toleranced length first process element and toleranced depth holes in second process elements. It should also be understood that the system of the present invention can be automated.

It is also emphasized that a relatively easily understandable mechanical embodiment of the present invention has been described in this Section of the Disclosure to facilitate a general understanding of the present invention. It is to be understood that functionally equivalent embodiments are also within the scope of the present invention, including those which utilize hydraulic means in place of Insertion and/or Toggle Means, and/or substitutes for the Tolerance Compensation Means wheel, and/or which utilize conveyor belt or rotatable transfer table etc. Transfer Means in place of the horizontally oriented channel means and shuttle bar combination described. The present invention can also be used to position process elements for processing rather than assembly by insertion. The full scope of the present invention will be better appreciated by reference to the Detailed Description Section of this Disclosure in conjunction with the accompanying Drawings.

Finally, upon reflection it should now be appearant that the needs identified in the Background Section of this Disclosure are met by the present invention system and method of use.

SUMMARY OF THE INVENTION

Assembly line production of systems comprised of a number of process elements requires that the process elements be interchangable. It is, however, impossible to eliminate manufacturing tolerances in various dimensions of similar process elements. Said tolerances can lead to system assembly problems in that system process elements which are means to precisely fit together, do not precisely fit together. In addition, precise positioning of one or more process elements for assembly or processing can be equally difficult.

Approaches to overcomming the identified problem include manufacture and preselection of tight, (i.e.. low tolerance), process elements prior to assembly thereof. Said approach, however, leads to material and man hour waste and can become prohibitively expensive. Another approach involves use of machines which facilitate the assembly process. Said machines typically fall into one of two classes, (eg. fixed stroke length and variable stroke length). Fixed stroke length machines are well suited for applications which require relatively large insertional forces to achieve a "press-fit" between two system elements. A press-fit is understood to be the result when a rod, for instance, of outer diameter "X" is forced into an essentially circular hole of inner diameter "X" or just slightly smaller. Fixed stroke length machines, however, do not accommodate system process element tolerances in, for instance, the lengths of first process elements, which first process elements are to be inserted into toleranced depth flat ended holes, for instance, in other process elements. Fixed stroke length machines are incapable of guaranteeing an intimate contact between the end of such a toleranced length first process element and the end of a toleranced depth flat ended hole in another process element, or of reliably, repeatably and consistently providing an intended gauging force between abutting ends of toleranced length first process element and toleranced depth holes in second process elements. It should also be appreciated that fixed stroke length machines can be relatively dangerous to operate. Variable stroke length machines can, on the other hand, serve to provide such an intimate contact between assembled process elements with a variable gauging force therebetween, (which is the force applied less the variable insertional force attributable to tolerances). Neither type of machine provides an independently controlled gauging force when an insertional force is required. A need is thus identified for an assembly/positioning system which facilitates assembly of toleranced process elements into assembled systems, which assembly/positioning system can provide required insertional force and simultaneously can also independently provide desired gauging force control such as variable stroke length machines can provide when relatively small insertional force is required. Such a machine should reliably, repeatably and consistently completely accommodate tolerances in process elements and in the elements of the system itself. Such a system should also be capable of allowing the positioning of process elements for processing.

A particularly relevant application for such an assembly machine is in the insertion of toleranced length primers into toleranced depth holes in bullet shell casings.

The present invention provides a fixed stroke length assembly/positioning system which provides independent gauging force control even though an insertional force is simultaneously required. That is, the present invention simultaneously allows exceeding the best results from both fixed and variable stroke length machines. The present invention is capable of, for instance, providing the necessary insertional force necessary to safely, repeatably, precisely and consistently insert toleranced diameter and length first process elements into toleranced diameter and depth holes in second process elements with intended gauging forces present between said process elements at their abutted point(s) of contact, without the requirement that a user of said invention have any special abilities other than the ability to follow a set sequence of steps. The present invention also allows use wherein the goal is positioning one process element with respect to another for assembly or for processing etc. In addition, the system and method of the present invention are relatively safe to operate and carry out.

The present invention system is comprised a Transfer Means, a Toggle Means, an Insertion Means and a Tolerance Compensation Means. In its relatively easily understood mechanical embodiment, the present invention system comprises a rigid frame which presents with a longitudinal dimension, in which, at an upper aspect thereof, when viewed with said longitudinal dimension projecting vertically from an underlying essentially horizontal surface, is present a Transfer Means which comprises a shuttle bar slidably inserted into a horizontally oriented channel, which shuttle bar presents with first and second vertically oriented holes present therethrough. During use a toleranced length first process element is caused to enter said first vertically oriented hole in said shuttle bar from a first upper vertically oriented hole in the top of said rigid frame. Said shuttle bar is then, after Toggle system and Tolerance Compensation System operation to compensate for tolerances in the length of said first toleranced length process element and the depth of a toleranced depth hole in said second process element, (and internal present invention system element tolerances), caused to slide so as to position said first vertically oriented hole in said shuttle bar under a second upper vertically oriented hole in the top of said rigid frame, which second upper vertically oriented hole accommodates said second process element which has the toleranced depth hole therein, into which toleranced depth hole the first process element is to be precisely inserted so as to achieve intimate contact between the end of said toleranced length first process element and the end of said toleranced depth hole, at an intended gauging force. In the relatively easily understood mechanical embodiment of the present invention the Toggle Means system comprises two plungers with upper ends thereof positioned to allow entry into said essentially horizontally oriented channel, and a centrally pivoted essentially horizontally oriented arm which supports the lower ends of said plungers, one at each end of said essentially horizontally oriented arm. The Insertion Means comprises first and second links which are pivotally connected to one another and to Toggle and Tolerance Compensation Means. The Tolerance Compensation Means comprises a second link lower end vertical level adjustment means which indirectly allows adjustment of the vertical location of the upper ends of the plungers via rotation of the second link.

Following a definite method of use, as described elsewhere in this Disclosure in which Transfer, Insertion, Toggle and Tolerance Compensation Means are operated by a user, causes a toleranced length first process element to be entered and precisely and intimately inserted into a toleranced depth hole in an entered second process element with an intended gauging force therebetween at their abutted point of contact, regardless of the insertional force required. For emphasis, this is the case even when a flat ended toleranced length first process element is to be inserted into a flat ended toleranced depth hole in a second process element so that the end of said flat ended toleranced length first process element is in flush intimate contact with the end of the toleranced depth flat bottom hole in the second process element, with an intended gauging force threbetween, even when variable insertional forces are required. Users of the present invention system and method of use, it is emphasised, need posses only the ability to follow a definite sequence of unvarying defined steps to achieve said ultimate result, emphasis added. That is, a user does not have to develop a "feel" to successfully utilize the present invention system, does not have to read and set gauges, make depth adjustable set-ups or repeatably handle toleranced process elements.

Alternative, functionally equivalent embodiments are within the scope of the present invention and include embodiments which utilize hydraulics in the Toggle and/or Insertion and/or Tolerance Compensation Means, and which utilize conveyor belts or rotary transfer tables etc. in the Transfer Means.

It is also mentioned that automation and simultaneous, sequential and/or parallel operation of a multiplicity of the present invention systems is within the scope of the present invention system and method.

It is also noted that the present invention can be positioned in any functional orientation during use. That is, what has been identified as the upper ends of the first and second plungers can be at a superior or inferior vertical position, or at any location in between during use.

It is therefore a purpose of the present invention to teach an assembly/positioning system and methods of use which facilitates precise and accurate insertion of low cost, easy to design and machine, toleranced length first process elements into mated tolerance depth holes in low cost, easy to design and machine second process elements in a manner which does not require the user to apply complicated math, sort process elements, fit process elements, use indicators, consider critical depth set-ups, develop a "feel" for operation thereof or undergo extensive training, yet increases the quality of an assembled system.

It is another purpose of the present invention to teach an assembly/positioning system and method of use which allows achieving precise flush intimate contact between the end of a toleranced length first process element and the end of a toleranced depth end of a hole in a second process element, with an intended gauging force present therebetween at the point of abutted contact between said first and second process elements.

It is yet another purpose of the present invention to teach an assembly/positioning system and method of use which serves to simultaneously nullify stress effected tolerances in assembly/positioning system elements, and tolerances in mated toleranced process elements during assembly thereof therein.

It is still yet another purpose of the present invention to teach an assembly/positioning system which allows precise positioning of one or more process elements for assembly or processing.

Yet another purpose of the present invention is to teach a assembly/positioning system and method of use which automatically compensates for thermal expansion, stresses and wear of said assembly/positioning system and of toleranced process elements assembled therein.

It is yet another purpose of the present invention to teach an assembly/positioning system and method of use which is especially well suited for use in assembling ultra-sensitive toleranced process elements.

It is still yet another purpose of the present invention to teach a assembly/positioning system and method of use which does not rely on a spring, or functional equivalent, force to adjust the assembly/positioning system operation.

Still yet another purpose of the present invention is to teach an assembly/positioning system and method of use which allows application of precisely controlled gauge pressure to control the gauging force between abutted ends of process elements assembled therein, regardless of the insertional force required to effect said assembly.

Another purpose of the present invention is to teach an assembly/positioning system which minimizes the time required to assemble toleranced process elements therein or position process elements for processing.

Yet another purpose of the present invention is to teach an assembly/positioning system which does not require removal of first and second toleranced process elements therefrom, once entered thereto for assembly, until assembly is complete.

Still yet another purpose of the present invention is to teach an assembly/positioning system which can be structured so as to allow multiple assembly processes to be performed simultaneously under the control of a single control assembly/positioning system.

Yet still another purpose of the present invention is to provide an assembly/positioning system which is relatively safe to use.

DETAILED DESCRIPTION

Figure 1:
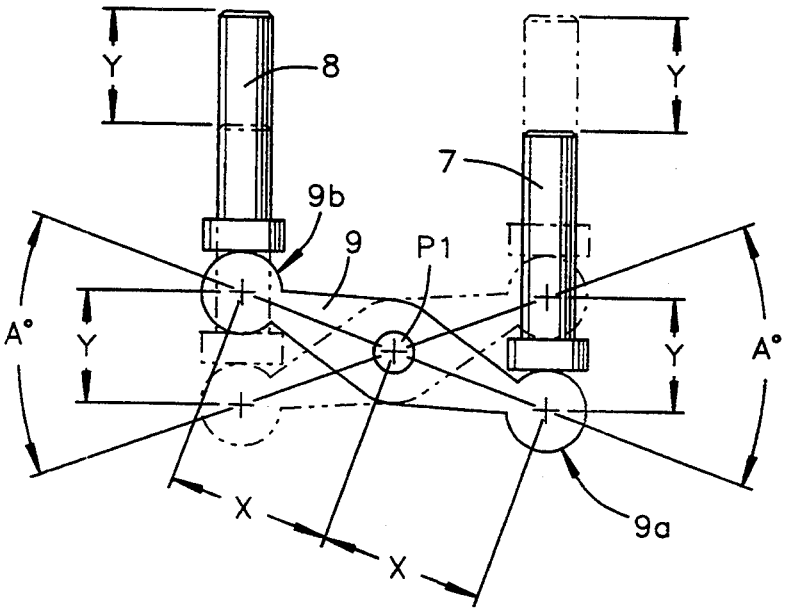
FIG. 1 shows a front elevational view of toggle means elements from a mechanical embodiment of the present invention system.

Turning now to the Drawings, there is demonstrated in FIG. 1 a front elevational view of a system of elements comprising a mechanical embodiment of Toggle Means of the present invention system. Shown are a first plunger (7), second plunger (8) and an essentially horizontally oriented arm (9). The lower end of first plunger (7) is shown to rest on a circular shaped portion (9*a*) of Toggle Means essentially horizontally oriented arm (9) at the right thereof as viewed in FIG. 1, and the lower end of second plunger (8) is shown to rest upon a circular shaped portion (9*b*) of essentially horizontally oriented arm (9) at the left thereof as viewed in FIG. 1. Note that there are shown both actual and phantom views of said Toggle Means. The actual view shows the essentially horizontally oriented arm (9) rotated clockwise from an actual horizontal position about pivot means (P1) by "A" degrees and the phantom view shows the essentially horizontally oriented arm (9) rotated slightly counter-clockwise about pivot means (P1) by "A" degrees. The system of the present invention will orient in both representative configurations during use thereof. Continuing, it is important to note that the distances identified by the letter "X" in FIG. 1, from the pivot means (P1) to the centers of the circular shaped portions (9*a*) and (9*b*) are equal, and that the distances identified by the letter "Y" which exist between the center points of the circular shaped portions (9*a*) and (9*b*) of actual and phantom views at each the left and right sides of the essentially horizontally oriented arm (9) in FIG. 1 are equal to the distances identified by the letter "Y" between the vertically highest top ends of each of the first and second plungers (7) and (8) in actual and phantom views at both the right and left sides of FIG. 1. It will then be appreciated that the positions of the top ends of first and second plungers (7) and (8) can be adjusted by rotation of essentially horizontally oriented arm (9) about pivot means (P1).

Figure 2:
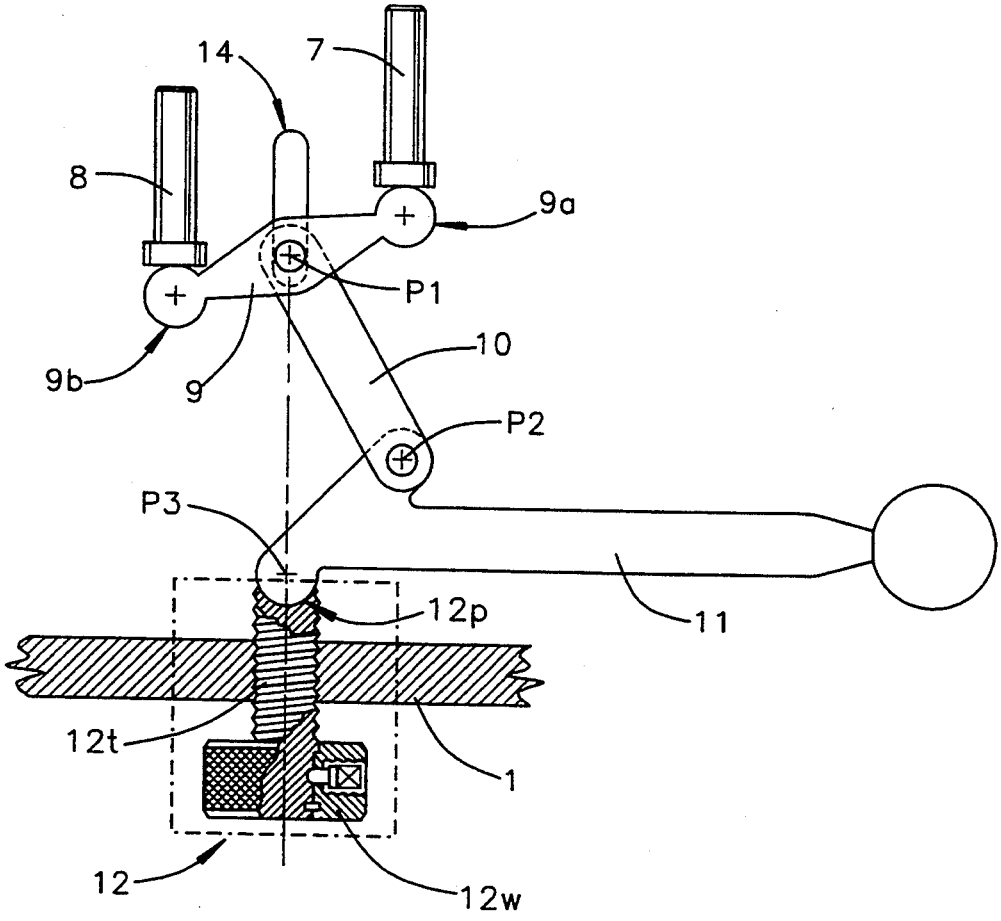
FIG. 2 shows a front elevational view of toggle, insertion and tolerance compensation means elements from a mechanical embodiment of the present invention system.

Turning now to FIG. 2, there is additionally shown Insertion Means (10) (11) and Tolerance Compensation Means (12) elements. A first link (10) is shown pivotally connected to the mid-point of essentially horizontally oriented arm (9) by pivotal connection means (P1). The lower end of said first link (10) is shown pivotally connected to the upper end of a second link (11) by pivotal connection means (P2), and the lower end of second link (11) is shown pivotally connected to the upper end of a threaded rod (12*t*) which is part of a Tolerance Compensation Means (12) by pivotal connection means (P3). Note that a force limiting force application wheel (12*w*) is attached to threaded rod (12*t*) in a manner which allows controlled slippage therebetween at a set point of applied rotational force. Also note that threaded rod (12*t*) is screwed into and through a threaded hole in a rigid frame (1) to position its upper end for pivotal connection to the lower end of second link (11). It is noted, though not shown in FIG. 2, that pivotal connection means (P1) has a rod projecting in what would be a rearward direction as viewed in FIGS. 1 and 2. Said rod projects into a slot in rigid frame (1). Said slot is better shown in FIGS. 3*a*–3*f* and identified by numeral (14) respectively. The purpose of said rod and slot is to keep pivotal connection means (P1) located vertically above pivotal connection means (P3) when second link (11) is caused to rotate about pivotal connection means (P3) to effect the raising or lowering of the upper end of first link (10) and the mid-point of essentially horizontally oriented arm (9) to which it is pivotally connected by pivotal connection means (P1). (See FIGS. 3*a* and 3*b*). Note that pivotal connection means (P3) could also utilize a similar rod and slot but is shown as comprising a cup (12*p*) on the upper end of adjustment means (12) threaded rod (12*t*) in which a complimentary connection means on the lower end of second link (11) is present. Pivotal connection means (P2) has no need for a similar rod and slot or cup means associated therewith. It is also to be understood that the Insertion Means and the Tolerance Compensation Means can be functionally oriented other than as shown and still be within the scope of the present invention. For instance, said tolerance compensation means could be placed between the first and second link or between the midpoint of the essentially horizontally oriented arm and the top of the first link etc.

Figure 9:
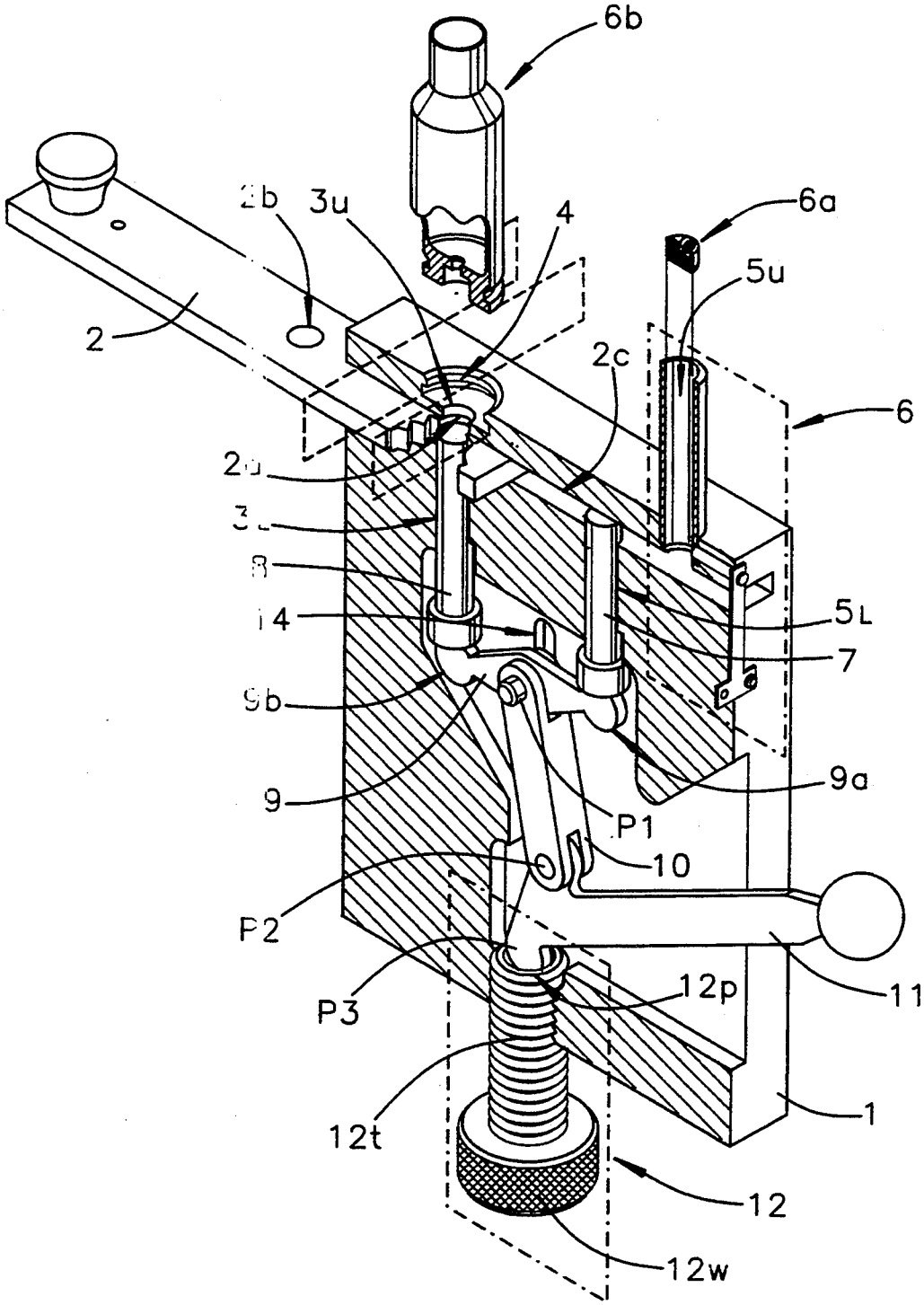
FIG. 9 shows a perspective cut-away view of transfer, toggle, insertion and tolerance compensation for a mechanical embodiment of the present invention system.

FIGS. 1 and 2 then show that the upper ends of first and second plungers (7) and (8) respectively can be caused to vertically raise or lower based upon the rotation of the Toggle Means essentially horizontally oriented arm (9) about its midpoint pivotal connection means (P1) connection to the Insertion Means upper end of first link (10), as well as by rotation of Insertion Means second link (11) about its lower end pivotal connection point, effected by pivotal connection means (P3), with the upper end of Tolerance Compensation Means (12) threaded rod (12*t*). The purposes of this will become clear in discussion of FIGS. 3*a*–3*f*. FIG. 9 provides a cutaway perspective view of the elements of the presently discussed mechanical embodiment of the present invention and might be helpful to view at this point and as the discussion progresses.

Figure 5:
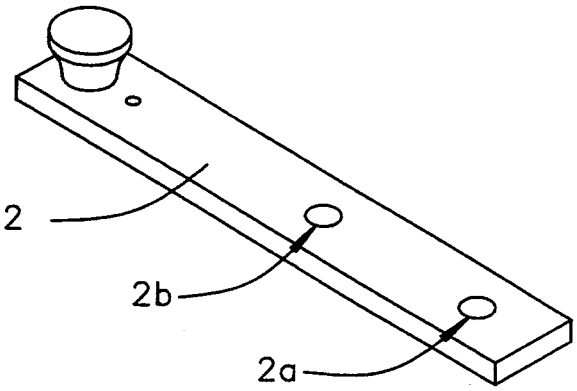
FIG. 5 shows a perspective view of the shuttle bar of a mechanical embodiment of the present invention system.

FIGS. 3*a*–3*f* show frontal cross sectional views of the working elements of the presently described relatively easily understood mechanical embodiment of the present invention, in various operational configuration states. Note that each successive FIG. 3*b*–3*f* shows a phantom view of the preceding operational configuration in FIGS. 3*a*–3*e* to aid with understanding. FIGS. 3*a*–3*f* will be referenced individually when the method of use of the present invention is presented below. Shown in FIGS. 3*a*–3*f* are a rigid frame (1) which, at its upper aspect has entry means (6) for use in entering a toleranced length first process element (6*a*), and securing means (4) for accommodating a second process element (6*b*), which second process element (6*b*) has a toleranced depth hole therein. Also shown are a first upper vertically oriented hole (5U) in the top of rigid frame (1) for use in entering toleranced length first process elements (6*a*) into a first vertically oriented hole (2*a*), in Transfer Means shuttle bar (2) during use. Second upper vertically oriented hole (3U) in the top of said rigid frame (1) is also shown and, as mentioned, is present in conjunction with the securing means (4) for use in accommodating said second process element (6*b*) with respect to rigid frame (1). Said upper vertically oriented holes (3U) and (5U) project through the top of said rigid frame (1) and into horizontally oriented channel means (2*c*) inside said rigid frame (1). Note that said horizontally oriented channel (2*c*) is shown as providing essentially continuous upper and lower surfaces from the right to the left side of said rigid frame (1), (as viewed in the Figures). This need not be the case and in fact only the upper surface above the first lower vertically oriented hole, termed the upper gauging surface, is absolutely required. (The terms horizontally oriented channel are to be interpreted to include any functional geometry). The reason for this will become clear when the method of use of the present invention is described. Shown in the upper aspect of said rigid frame (1) then are Transfer Means, specifically said shuttle bar (2) present in horizontally oriented channel means (2*c*), which shuttle bar (2) has at least first (2*a*) and second (2*b*) vertically oriented holes therethrough. (See FIG. 5). It is noted that the entry means (6), securing means (4), horizontally oriented channel (2*c*) in rigid frame (1) and shuttle bar (2) additionally comprise auxiliary optional Transfer Means of the presently described embodiment of the present invention. Continuing, the presently discussed embodiment of the present invention also comprises Toggle Means. Said Toggle Means comprise first and second plungers (7) and (8), and essentially horizontally oriented arm (9). Shown also are Insertion Means first link (10) and second link (11). As discussed above, first plunger (7) and second plunger (8), at their lower ends, are supported by opposite ends of essentially horizontally oriented arm (9) by circular shaped portions (9*a*) and (9*b*) respectively. Essentially horizontally oriented arm (9) is pivotally connected at a mid-point thereof to first link (10), at the upper end of said first link (10) by connection means (P1). First link (10) is pivotally connected at its lower end to the Upper end of second link (11) by pivotal connection means (P2) and second link (11) is pivotally connected at its lower end to a threaded rod (12*t*) by pivotal connection means (P3). Said threaded rod (12*t*) is a member of Tolerance Compensation Means (12), which serves to adjust the vertical position of the lower end of said second link (11) with respect to rigid frame (1) when wheel (12*t*) is rotated. Rotation of said wheel (12*w*) causes the lower end of second link (12) to move vertically upward or downward with respect to the rigid frame (1), depending upon the direction of rotation. It should be appreciated that raising or lowering the lower end of second link (11) will also indirectly cause the vertical level of the essentially horizontally oriented arm (9) to effectively raise or lower with respect to the rigid frame (1). The purpose for this will, again, be explained further, hereinafter. Continuing, first plunger (7) projects through a first lower vertically oriented hole (5L) in rigid frame (1) at a location such that projecting said first plunger (7) through said first lower vertically oriented hole (5L), when said shuttle bar (2) is slid to the left, (as viewed in FIGS. 3*a*–3*f*), far enough so that the right end thereof is to the left of said first lower vertically oriented hole (5L), causes the upper end of said first plunger (7) to contact the upper "gauging" surface of said horizontally oriented channel means (2C) in rigid frame (1). Second plunger (8) projects through a second lower vertically oriented hole (3U) in rigid frame (1) directly beneath second upper vertically oriented hole (3U) in rigid frame (1).

It is to be understood that functionally equivalent means to any described system elements are to be considered within the scope of the present invention.

With the system of the preferred embodiment of the present invention now essentially disclosed, attention is turned to the method of operation said system.

It should be kept in mind, while reading what follows, that the purpose of the present invention is to provide an assembly/positioning system and method of use for safely, precisely, repeatably and consistently inserting or positioning toleranced length first process elements into toleranced depth holes in second process elements, or otherwise positioning process elements for processing or assembly, which assembly/positioning system and method of use can be safely practiced by users who have no special abilities other than the ability to follow a definite set of procedural steps. That is, practice of the method of use of the present invention system automatically adjusts for internal assembly/positioning tolerances and for the identified process elements dimensional tolerances during the insertion of a toleranced length first process element into a toleranced depth hole in a second process element. It is specifically to be understood that the definition of toleranced length first process element is to be considered broad enough to include a relatively flat element, such as the hood of a car present in a large scale assembly/positioning system, which is to be placed in position for mounting to a car body. As well, a process element can be positioned by the present invention for processing, perhaps for cutting by a laser. Also, when the present invention is used to position a first process element near a second process element it is not required that a toleranced depth hole be present therein. That is, the specific geometry shown in the FIGS. and described insertion method is demonstrative and not limiting.

Figure 3A:
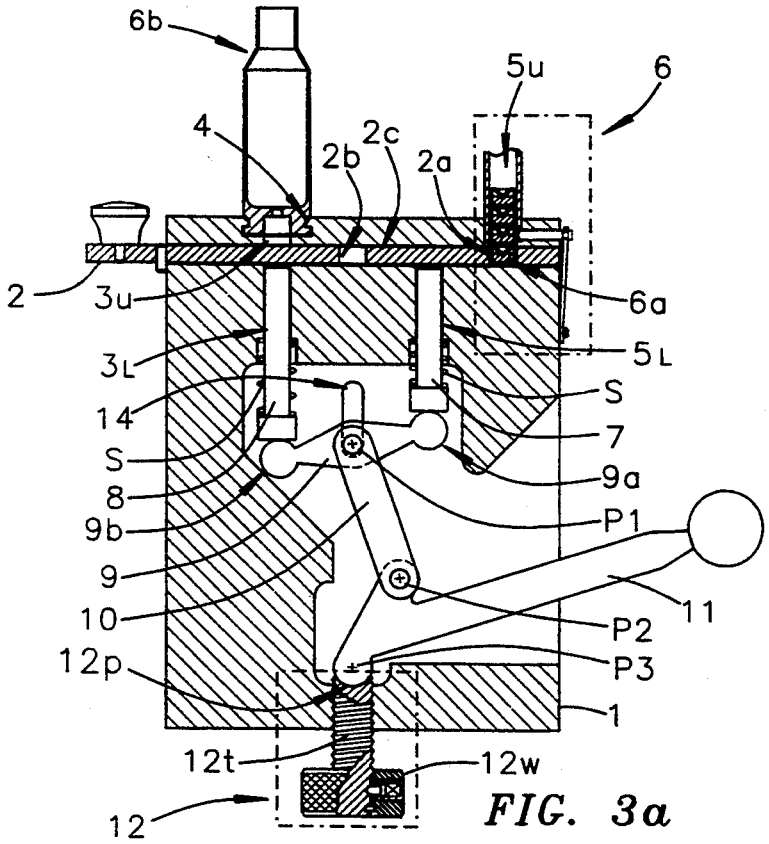
FIGS. 3*a*–3*f* show front cross-section elevational views of transfer means, toggle means, tolerance compensation means and insertion means elements of a mechanical embodiment of the present invention system, each showing said elements in different orientations corresponding to different steps during the practice of the method of the present invention.
Figure 3B:
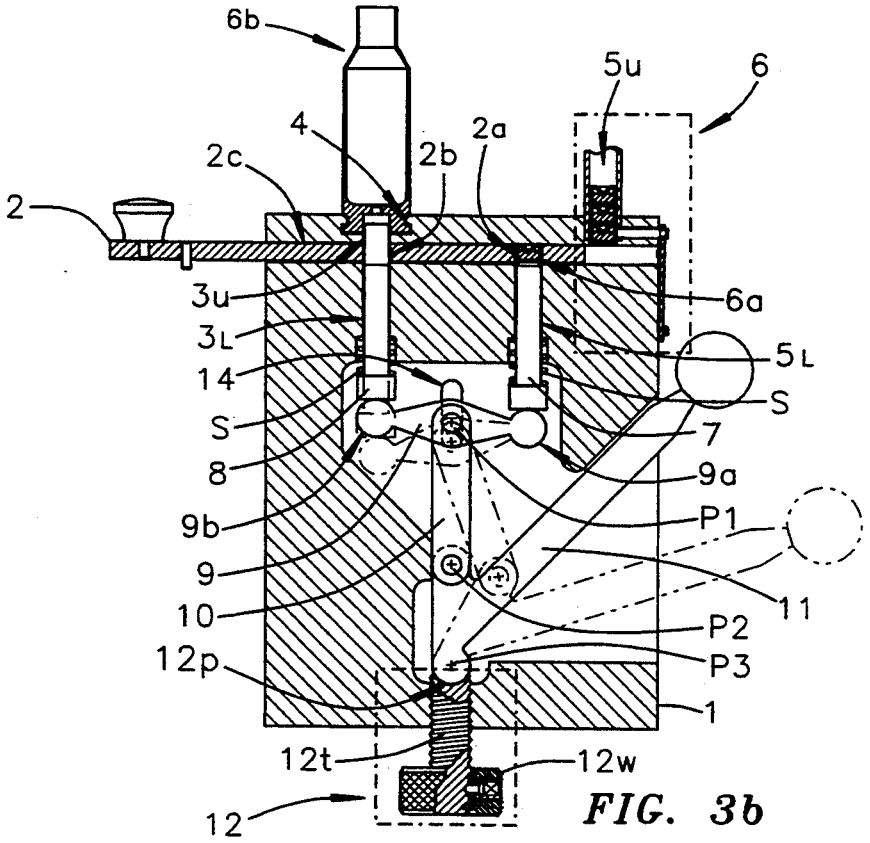
Figure 3C:
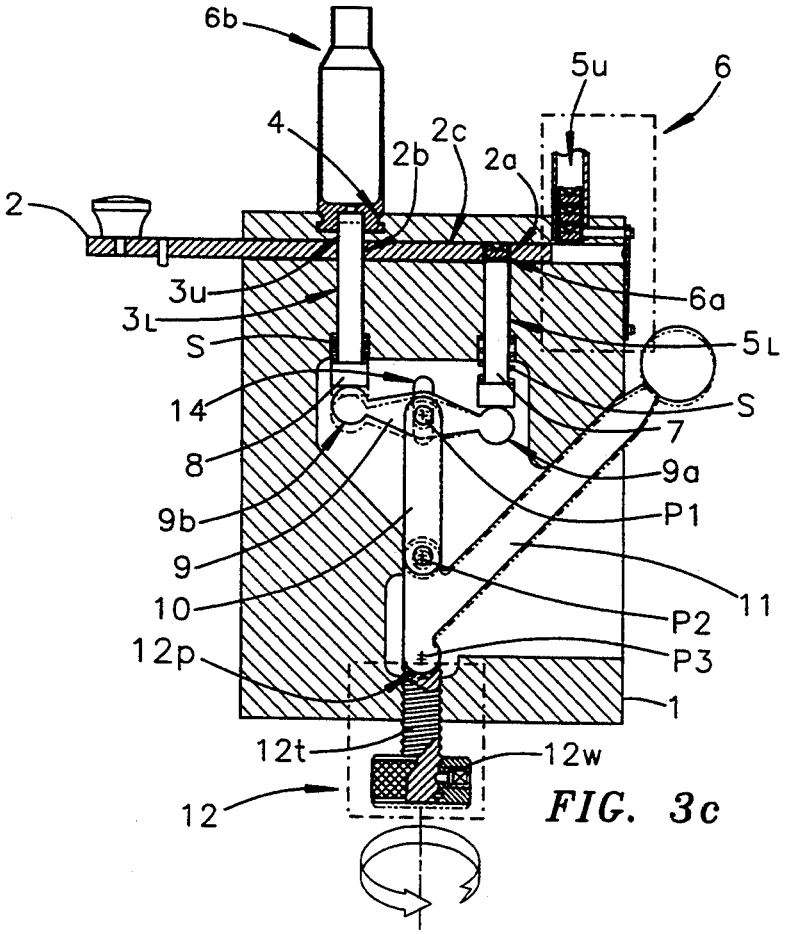

Referring to FIG. 3*a*, it will be appreciated that Transfer Means shuttle bar (2) is shown positioned within horizontally oriented channel means (2*c*) of rigid frame (1) such that first vertically oriented hole (2*a*) in shuttle bar (2) is oriented directly beneath entry means (6) and first upper vertically oriented hole (5U) in said rigid frame (1). Toleranced length first process element (6a) is shown loaded into said shuttle bar (2) first vertically oriented hole (2a) from entry means (6). Second shuttle bar (2) vertically oriented hole (2b) is also shown in horizontally oriented channel means at a point above but between first lower vertically oriented hole (5L) and second lower vertically oriented hole (3L) in rigid frame (1). It is important, with respect to FIG. 3a, to also note that second link (11) has been rotated clockwise, (as viewed in the Figures), to a position which effectively causes essentially horizontally oriented arm (9) to assume a lower vertical position with respect to rigid frame (1), than is the case shown in FIG. 3b. With said second link (11) so rotated, the upper ends of first plunger (7) and second plunger (8), it will be appreciated, will not enter the region within horizontally oriented channel means (2c), and shuttle bar (2) first vertically oriented hole (2a) or second vertically oriented hole (2b) respectively, as can occur when said second link (11) is rotated counterclockwise as shown in FIG. 3b. Said shuttle bar (2) can then be caused to slide into a position such as demonstrated in FIG. 3b or 3f. That is, rotating second link (11) clockwise to a position as shown in FIG. 3a causes shuttle bar (2) to be freed-up to be caused to slide within horizontally oriented channel means (2c) in rigid frame (1). FIG. 3a demonstrates, it will be appreciated, the present invention system in a toleranced length first process element (6a) loading configuration. It should also be noted that wheel (12t) of Tolerance Compensation Means (12) will typically, but not necessarily, be rotated to position the lower end of second link (11) at its lowest possible position within rigid frame (1) during the process of loading a toleranced length first process element (6a) into the first vertically oriented hole (2a) in shuttle bar (2). Requiring such keeps the method of use of the present invention one of requiring only definite sequentially applied steps.

Turning now to FIG. 3b, it will be appreciated that shuttle bar (2) has been caused to slide to the left, (as viewed in the Figures), in horizontally oriented channel means (2c) in rigid frame (1) so that shuttle bar (2) first vertically oriented hole (2a), with toleranced length first process element (6a) loaded thereinto, is positioned directly above first lower vertically oriented hole (5L) in rigid frame (1). As well, shuttle bar (2) second vertically oriented hole (2b) is simultaneously positioned directly below second upper vertically oriented hole (3U) and above second lower vertically oriented hole (3L) in rigid frame (1). This is a necessary result based upon proper fabrication of said shuttle bar (2) and rigid frame (1) to their relative design dimensions. Note also that in FIG. 3b, second link (11) is rotated counterclockwise, (as viewed in the FIGS.), so that essentially horizontally oriented arm (9) is at a higher vertical level, with respect to the rigid frame (1), than was the case shown in FIG. 3a. This causes the upper end of first plunger (7) to approach, or contact, the lower end of toleranced length first process element (6a) present in shuttle bar (2) first vertically oriented hole (2a). Simultaneously, the upper end of second plunger (8) is caused to approach or enter shuttle bar (2) second vertically oriented hole (2b) and project toward or into the toleranced depth hole within second process element (6b), into which toleranced depth hole toleranced length first process element (6a) is to be precisely and intimately inserted by further operation of the present invention. When the present invention system is configured as just described with respect to FIG. 3b, a user following the method of operation of the system of the present invention will next rotate Tolerance Compensation Means wheel (12t) so that the upper ends of first and second plungers (7) and (8) are both raised to their highest achievable levels consistent with the limited amount of rotational force which wheel (12t) is capable of applying to threaded rod (12t). Recall that wheel (12t) is typically connected to threaded rod (12t) to allow controlled slippage when a rotational force in excess of a desired rotational force is applied thereto. First plunger (7) will then be caused to firmly sandwich and "prestress" toleranced length first process element (6a), present in shuttle bar (2) first vertically oriented hole (2a), between the upper end of first plunger (7) and the upper gauging surface of horizontally oriented channel means (2C) in rigid frame (1), and second plunger (8) will be caused to firmly contact the vertically highest end of the toleranced depth hole in second process element (6b). That is, the described rotation of wheel (12t) will compensate for any tolerances in the length of a toleranced length first process element (6a) and the depth of the toleranced depth hole in second process element (6b). In addition, tolerances caused by stresses and temperature etc. in the elements of the assembly/positioning system and in said first and second process elements will also be compensated by this step. The actual view in FIG. 3c, it will be appreciated, shows the upper end of the essentially horizontally oriented arm raised a bit by the operation of the Tolerance Compensation Means (12). Note that essentially horizontally oriented arm (9) will be rotated slightly clockwise as a result of the described processes. This is shown well in FIG. 3c, which corresponds to the actual view shown in FIG. 1.

Figure 3D:
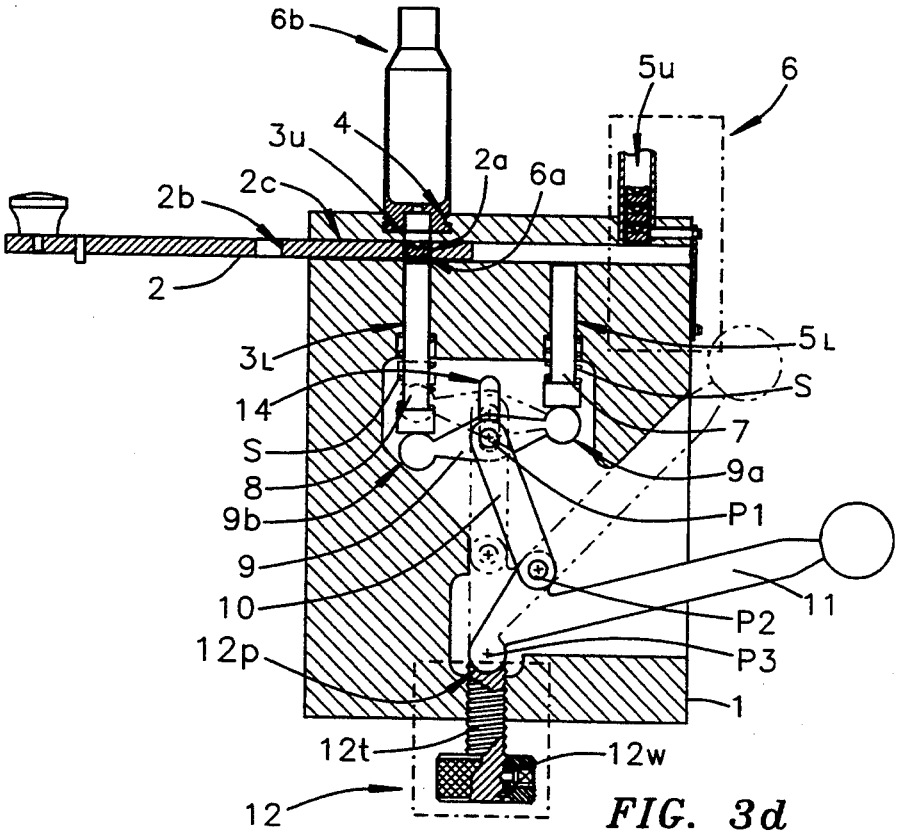
Figure 3E:
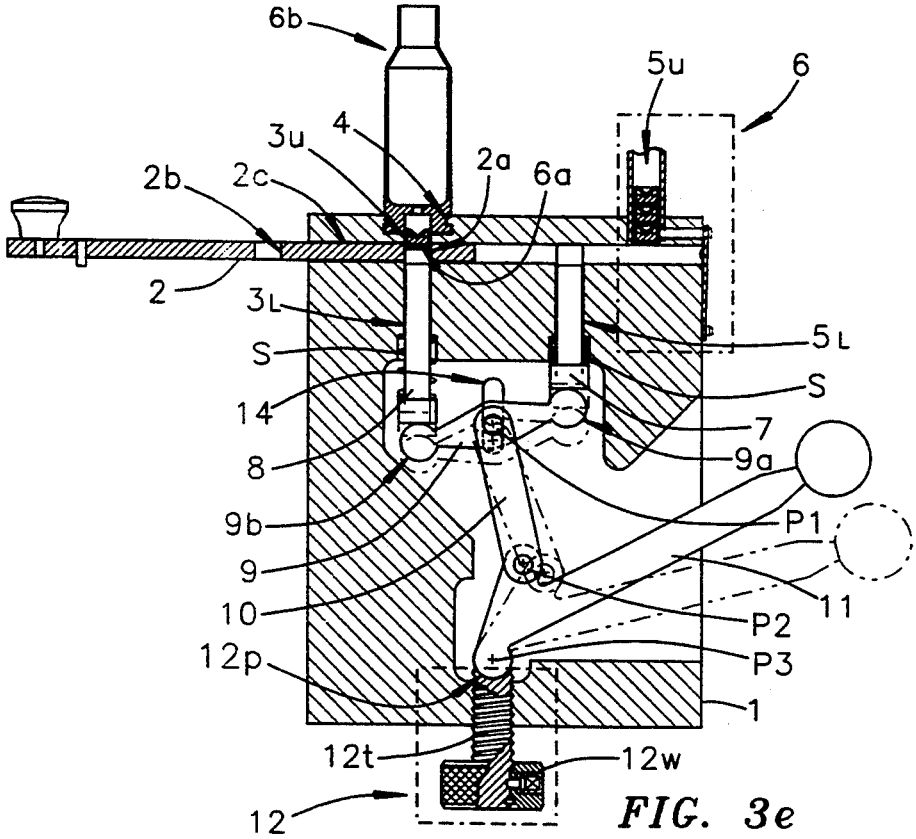
Figure 3F:
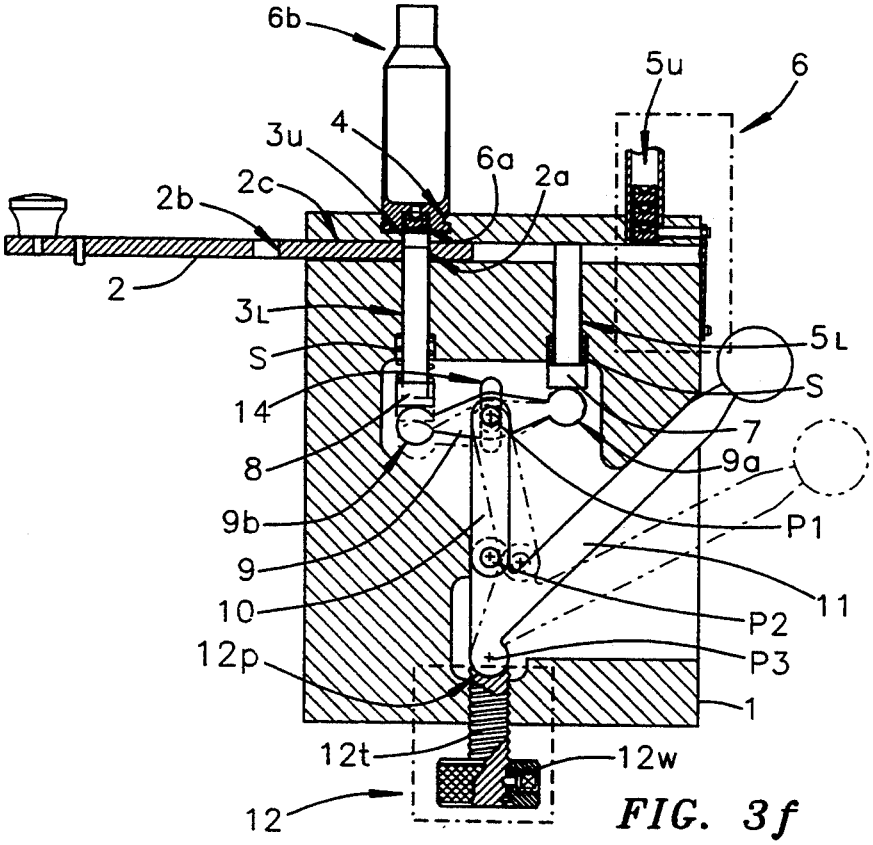

A user of the present invention will, at this point in the method of use thereof, again rotate second link (11) clockwise, (as viewed in the Figures), so that it is configured as shown in FIG. 3d. This will, as described above, cause the upper ends of first and second plungers (7) and (8) to be removed from the first and second vertically oriented holes (2a) and (2b) in shuttle bar (2), thereby freeing shuttle bar (2) so that it can again be caused to slide within horizontally oriented channel means (2c) in rigid frame (1). FIG. 3e shows the configuration a user will next place the invention system in, when following the method of use of the system of the present invention. Note that second vertically oriented hole (2b) in shuttle bar (2) is caused to be positioned outside the rigid frame (1), and that first vertically oriented hole (2a) in shuttle bar (2), with toleranced length first process element (6a) therein, is caused to be positioned directly above second lower vertically oriented hole (3L) in rigid frame (1), and simultaneously by necessity imposed by the system of the present invention, directly beneath second upper vertically oriented hole (3U) in the rigid frame (1), securing means (4) and the toleranced depth hole in second process element (6b) into which the toleranced length first process element (6a) is to be precisely and intimately inserted. FIG. 3f shows second link (11) rotated counterclockwise, (as viewed in the Figures), so as to effectively vertically raise the upper ends of first and second plungers (7) and (8) with respect to the rigid frame. Note that the upper end of first plunger (7) flushly contacts the upper gauging surface of the horizontally oriented channel means (2c) in the rigid frame (1), and that the upper end of second plunger (8) forces toleranced length first process element (6a) into the hole in second process element (6b) so that the upper end of said toleranced length first process element (6*a*) flushly contacts and abutts against the upper vertical end, (as viewed in FIG. 3*f*), of the toleranced depth hole in second process element (6*b*). Note that the shuttle bar (2) is typically designed so that the rightmost end thereof will be located to the left, (as viewed in the FIGS. 3*e* and 3*f*) of the lower vertically oriented hole (5L) in rigid frame (1) when the system of the present invention is configured as just described. In the alternative, an additional vertically oriented hole can be fabricated into an elongated shuttle bar (2) to allow first plunger (7) to project into and therethrough during this step in the method of use of the system of the present invention.

It should be appreciated that a fixed stroke length motion, (e.g. rotating second link (11) counterclockwise about its pivotal connection means (P3) with the upper end of threaded rod (12*t*), as viewed in the Figures), to effectively vertically raise the upper ends of first and second plungers (7) and (8) to the positions shown in FIG. 3*f* with necessary insertional force to overcome insertional resistance, effectively provides a variable stroke length result as regards inserting the toleranced length first process element (6*a*) into the toleranced depth hole in second process element (6*b*) at an intended gauge force between the abutted surfaces of the contacting toleranced length first process element and the upper end of the toleranced depth hole in the second process element, because of the adjustment effected by rotation of Tolerance Compensation Means wheel (12*w*), and because of the rotational action of the essentially horizontally oriented arm (9) about its midpoint pivotal connection (P1) to the upper end of first link (10), as described above. The present assembly/positioning system, however, provides a result even superior to that achievable with a variable stroke length machine as it provides an intended gauging force independent of, and in the presence of, a required insertion force. This is considered a very important distinguishing point regarding the present invention, emphasis added. It should also be appreciated that the method of use of the present invention, requires no special abilities on the part of a user, other than the ability to repeatably follow a fixed set of instructions.

The present invention then provides a system and method of use which safely, precisely, repeatably and consistently allows the insertion of toleranced length first process elements into toleranced depth holes in second process elements by users with only minimal skills. The present invention can also serve with equal convenience, to position a process element for assembly or processing. That is, the toleranced depth hole in a second process element need not be present when the toleranced length first process element is pushed upward by the upper end of the second plunger (8). A laser, for instance, can be present to trim a toleranced length first process element where the toleranced depth hole would otherwise be located. In such a scenario, the toleranced depth hole in the second process element should be interpreted to be the first hole (2*a*) through the shuttle bar (2) through which second plunger (8) extends when positioning a toleranced length first process element (6*a*) through upper second vertically oriented hole (3U) in rigid frame (1), for the purpose of interpreting Claim language.

It should also be noted that the system of the present invention can, as shown in FIGS. 3*a*–3*f*, include springs (S) associated with the first and second plunger (7) and (8). Said springs serve to force said first and second plungers (7) and (8) vertically downward with respect to rigid frame (1) when second link (11) is rotated clockwise, (as viewed in the Figures), to a configuration as shown in FIGS. 3*a* and 3*d*, or when Tolerance Compensation Means wheel (12*w*) is rotated so as to effectively cause a similar vertical motion of the upper ends of said first and second plungers (7) and (8). Said springs (S) also allow the present invention to be used in orientations other than those shown in the Figures. That is, the vertically upper aspects of the present invention, (as the term "vertical" applies with respect to the Figures), system could be oriented to project horizontally, and the present invention would still operate. The Claims are to be interpreted to include such an orientation of the present invention during use. That is the use of terms such as vertically upper, vertically lower, vertically oriented and horizontally oriented etc. were used only to facilitate disclosure and description of the present invention system and method of use, not to restrict the orientation of the overall present invention system during use. In addition, a sequential series of systems as described could be assembled to allow a user to simultaneously load a multiplicity of toleranced length first process element into toleranced depth holes in a multiplicity of second process elements etc. with a common operation of the systems. Of course, Tolerance Compensation Means wheels (12*w*) of each of the interconnected systems would have to be individually rotated to adjust each system to compensate the toleranced length first process element length and toleranced depth hole in a second process element present therein, but common operation of the sliding of the shuttle bars and of the rotation of the second links in all such interconnected systems could be effected. The present invention method of use, it should also be appreciated, can be automated. This applies to any embodiment thereof.

Figure 4:
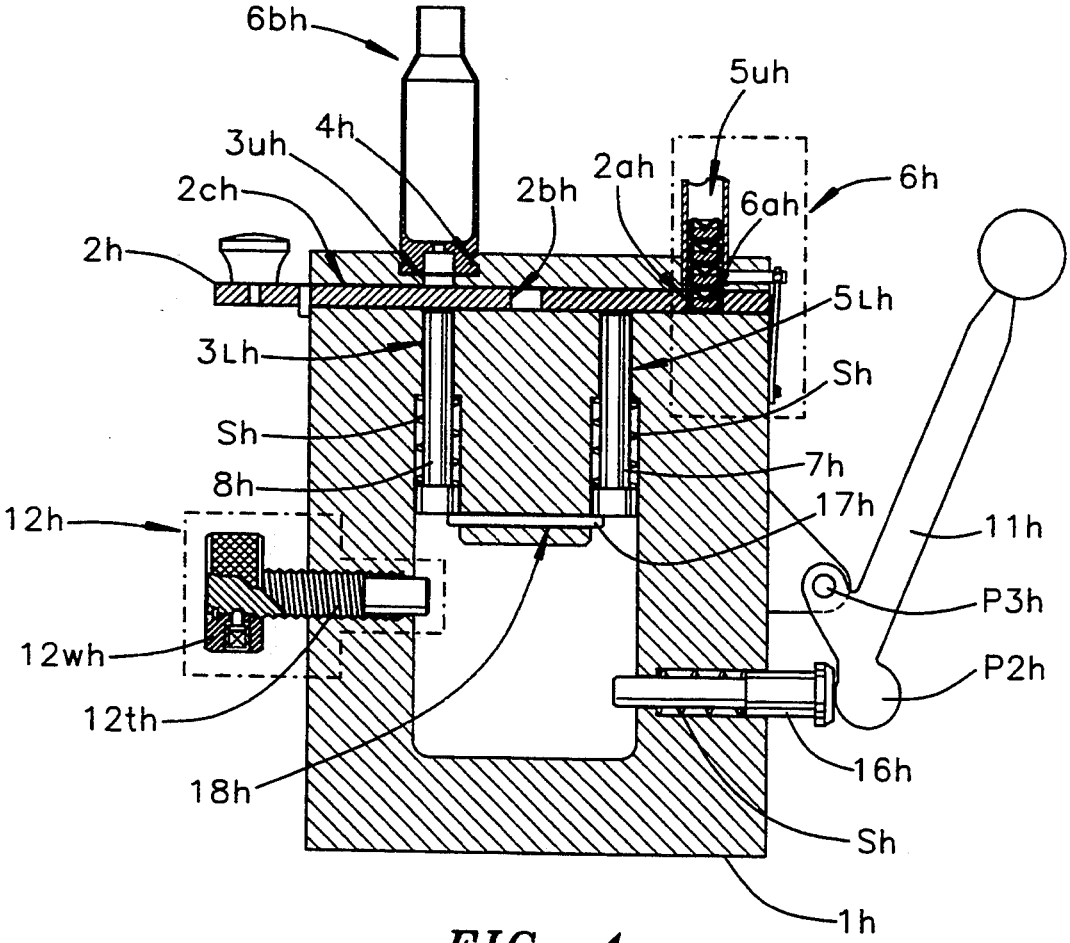
FIG. 4 shows a front cross section elevational view of an embodiment of the present invention system which utilizes hydraulic toggle, insertion and tolerance compensation means, but mechanical transfer means.

Turning now to FIG. 4, there is shown an alternate, but analogically functionally equivalent, embodiment of the present invention system. In particular the essentially horizontally oriented arm (9) Toggle Means, the first link (10) and associated pivotal connection means (P1), (P2) and (P3) Insertion Means shown in earlier Figures have been replaced with a cavity which is filled with hydraulic fluid, a modified second link (11*h*) and modified Tolerance Compensation Means (12*h*). The hydraulic fluid present in said cavity contacts the lower ends of the first and second plungers (7*h*) and (8*h*) and is also accessed by modified Insertion Means second link (11*h*) and modified Tolerance Compensation Means (12*h*) wheel (12*wh*) and threaded rod (12*th*) elements. (Note, elements shown in FIG. 4 which are functionally analogical to elements shown in FIGS. 1–3*f* are provided similar identifying numerals with an "h" appended). As a result the preceding discussion which focused on FIGS. 1–3*f* is generally applicable to the embodiment shown in FIG. 4 with). The embodiment shown in FIG. 4 operates much the same as does that previously discussed with respect to FIGS. 1–3*f*, with the understanding that rotation of wheel (12*wh*) causes displacement of hydraulic fluid in the cavity which contains it, rather than the movement of the lower end of second link (11), to indirectly cause the upper ends of first and second plungers (7*h*) and (8*h*) to move upward or downward. Similarly, operation of second link (11*h*) also causes a similar displacement of hydraulic fluid in the cavity which contains it to effect the upward or downward motion of the upper ends of first and second plungers (7*h*) and (8*h*). Note in particular that modified Tolerance Compensation means (12*h*) effects independent control of the gauging force and the Insertional Means second link (11*h*) provides the insertional force.

Figure 10:
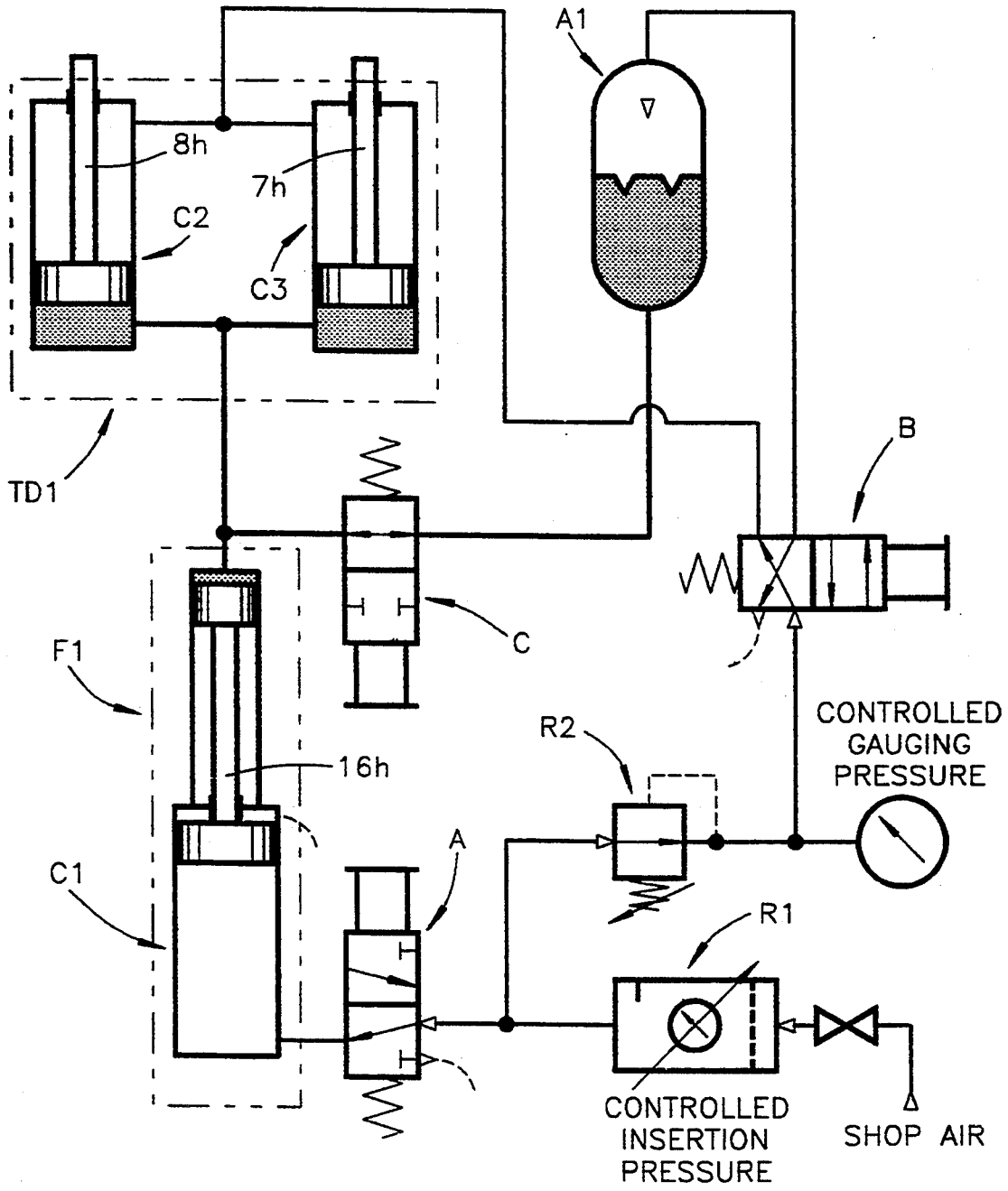
FIG. 10 shows a schematic diagram of the toggle, insertion and tolerance compensation means of an embodiment of the present invention system which utilizes hydraulics and pneumatics.
Figure 11:
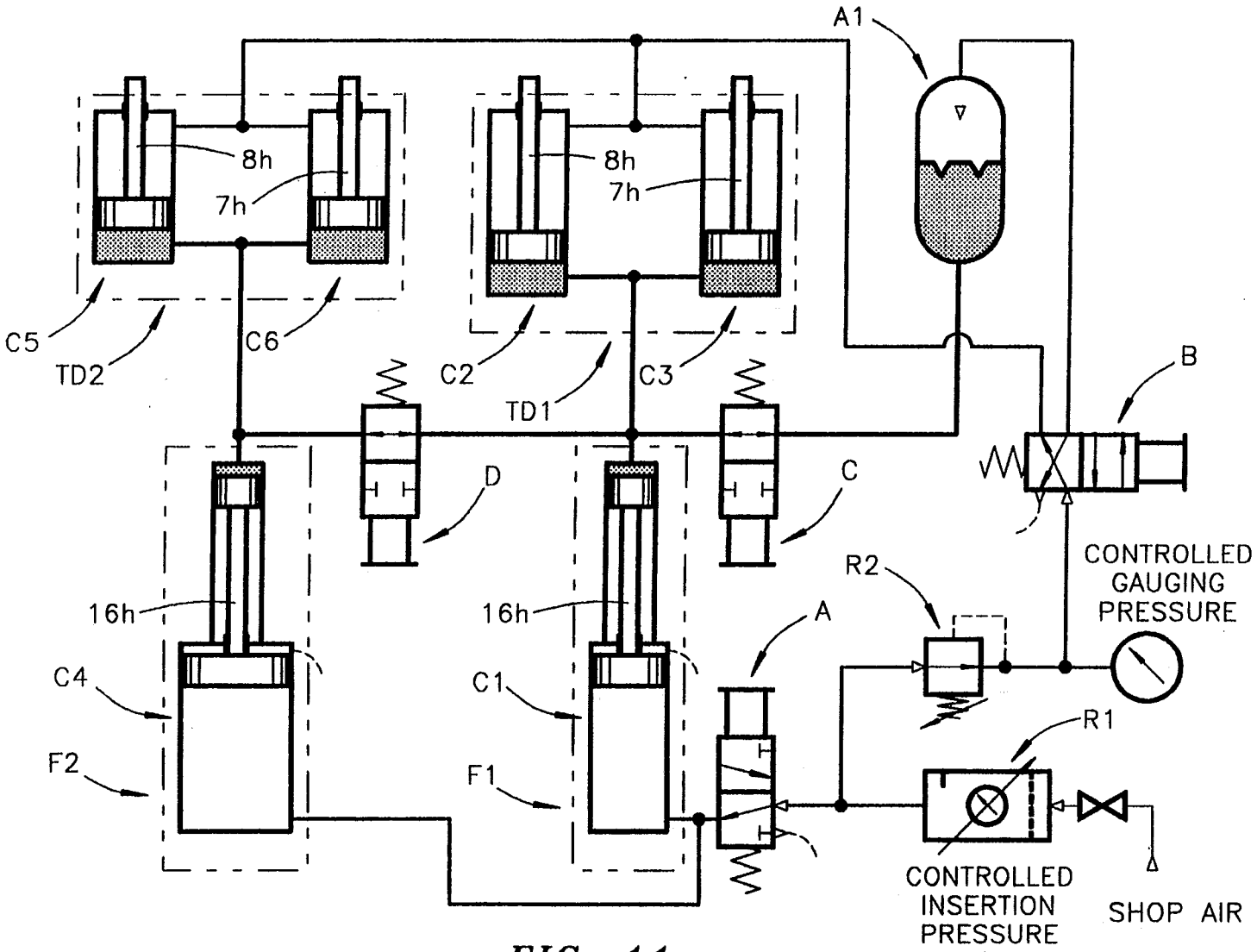
FIG. 11 shows a schematic diagram of an embodiment of the toggle, insertion and tolerance compensation means of the present invention which utilizes hydraulics and pneumatics showing two toggle systems operating from one hydraulic accumulator.

Turning now to FIGS. 10 and 11, there are shown additional hydraulically based embodiments of the present invention Toggle, Insertion and Tolerance Compensation Means. Transfer Means are not shown but can be of the shuttle bar type as described with respect to FIGS. 3*a*–3*f*, or of conveyor belt or rotary transfer table design or any functionally equivalent design, just as can be the case with previously described embodiments. Shown in FIGS. 10 and 11 are sealed chambers (C1), (C2) and (C3) which contain therein third, second and first plungers (16*h*), (8*h*) and (7*h*) respectively. Note that air and hydraulic fluid portions exist within said sealed chambers, on opposite sides of said plungers. Entry of air to an air portion within a sealed chamber causes the associated plunger to apply pressure to the hydraulic fluid in the hydraulic fluid portion. (Note that oil could be substituted for air and provide a functionally equivalent result. Air is used in the following description only as an example of a readily available fluid). Said pressure, in combination with the surface area over which it is applied, causes transmission of a force through a hydraulic circuit of which it is a part. Also shown in FIGS. 10 and 11 are valves (A), (B) and (C). Each said valve is shown with two possible positions. It is to be understood that the lines and arrows inside each valve position indicating portion indicate what said valve does when operated to provide said portion thereof to the shown hydraulic circuit. That is, the arrows show "flow conditions". For instance, valve (A) is shown in FIG. 10 configured to allow insertional force providing air pressure from regulator (R1) to the air portion of third piston (16*h*) in sealed chamber (C1). If said valve (A) were operated to provide its opposite pole to the hydraulic circuit, the air side of said sealed chamber (A) would be vented to the atmosphere. The other valves can be interpreted in a similar manner. Note that regulators (R1) and (R2), which control insertional and gauging pressures applied to process elements during use, are also shown.

Focusing now on FIG. 10 there are shown first and second plungers (7*h*) and (8*h*) in sealed chambers (C3) and (C2) respectively. Note that sealed chambers (C2) and (C3) are shown in a block labeled (TD1). This is to indicate that said sealed chambers form a single Toggle Means system. Sealed chamber (C1) in block (F1) contains a third plunger (16*h*) the upper end of which is in a hydraulic circuit with the lower ends of first and second plungers (7*h*) and (8*h*), such that a movement thereof upward or downward indirectly simultaneously causes the upper ends of first and second plungers (7*h*) and (8*h*) to follow. This is an analogically functionally equivalent effect to that produced by rotating Insertional Means second link (11) in shown in FIGS. 3*a*–3*f* regarding the earlier discussed mechanical embodiment of the present invention. The function associated with the Tolerance Compensation Means elements (12*w*) and (12*t*) in FIGS. 3*a*–3*f* is performed in the present embodiment in conjunction with accumulator (A1). To understand why this is, it must only be realized that rotation of wheel (12*w*) in FIGS. 3*a* 3*f* is functionally analogically equivalent to adding or draining hydraulic fluid to or from the circuit between the top of third plunger (16*h*) and the lower ends of first and second plungers (7*h*) and (8*h*) in FIG. 10. Both actions indirectly cause the upper ends of first and second plungers (7) and (8) and (7*h*) and (8*h*) to raise or lower in analogically equivalent manners. The hydraulic based embodiment of FIG. 10 achieves the intended result through use of valves, sources of pressure and metering devices, rather than through use of mechanical elements. For instance, assume that the valve (C) in FIG. 10 is configured as shown. A hydraulic fluid circuit then will allow hydraulic fluid to flow between the accumulator (A1) and the hydraulic fluid circuit between the top end of plunger (16*h*) and the lower ends of first and second plungers (7*h*) and (8*h*). The amount of hydraulic fluid entered from or removed to the accumulator (A1) will then depend on how much gauging pressure is provided to said accumulator (A1) via valve (B). Valve (B) will be in a position opposite to that shown during said operation to vent the air sides of sealed chambers (C2) and (C3). Valve (A) will present the air side of sealed chamber (C1) with insertion pressure during such an operation so that third plunger (16*h*) will move within said chamber to its vertically highest possible position. With an appropriate amount of hydraulic fluid entered to the hydraulic fluid circuit between the upper end of third plunger (16*h*) and the lower ends of first and second plungers (7*h*) and (8*h*) valve (C) can be operated to remove said accumulator (A) from said hydraulic fluid circuit to effect a "closed system", and valve (A) can be operated to remove insertional pressure from the air side of sealed chamber (C1). This will allow the upper ends of first and second plungers (7*h*) and (8*h*) to lower, assuming valve (B) is in its normal position. It should then be appearant and appreciated that FIG. 10 provides a hydraulically based embodiment of the present invention which is functionally equivalent to that described above with reference to FIGS. 3*a*–3*f* and 4.

To further aid understanding, a sample cycle of use is presented.

Step 1. Resting Position.

| | |
|---|---|
| A1 | Vented |
| C1 | Under insertional pressure |
| C2 & C3 | vented |
| Valve A | Normal (non-actuated) |
| Valve B | Normal (non-actuated) |
| Valve C | Open (normal) |

Gauging air pressure is provided to the air portions of sealed chambers (C2) and (C3) and insertional air pressure is entered to the air portion of sealed chamber (C1). Accumulator (A1) is vented. Hydraulic fluid displaced from sealed chambers (C1), (C2) and (C3) flows into accumulator (A1). Plungers (7*h*) and (8*h*) are fully retracted.

Step 2. Gauging Started.

| | |
|---|---|
| A1 | *Under gauging pressure |
| C1 | Under insertional pressure |
| C2 & C3 | Vented |
| Valve A | Normal (non-actuated) |
| Valve B | *Actuated |
| Valve C | Open (normal) |

(note, an "*" indicates change from prior position)

Second process element, (not shown), with a toleranced depth hole therein is placed above C2 and toleranced length first process element, (not shown), is placed above C1 by Transfer Means, (not shown). Valve (B) is actuated to vent air portions of C2 and C3 and to provide gauging pressure to accumulator (A1).

Hydraulic fluid from accumulator flows into hydraulic fluid portions of sealed chambers (C2) and (C3) because valve (C) is open. The upper ends of first and second plungers (*7h*) and (*8h*) are thus forced upward until the top of first plunger (*7h*) sandwiches toleranced length first process element, (not shown), against a gauging surface, (not shown), and until the top of second plunger (*8h*) is flush against the vertically upper end of the toleranced depth hole in second process element, (not shown). This comprises the tolerance compensation step. The internal system elements are stressed as are the first and second process elements, and all said tolerances are compensated. Any tolerances resulting from thermal sources are also compensated.

Step 3. Gauging Ended.

| | |
|---|---|
| A1 | Under gauging pressure |
| C1 | Under insertional pressure |
| C2 & C3 | Vented |
| Valve A | Normal, (non-actuated) |
| Valve B | Actuated |
| Valve C | *Closed, (actuated) |

Valve (C) is closed thereby creating a closed hydraulic circuit between hydraulic fluid portions of sealed chambers (C1), (C2) and (C3). This sets the system in a fully toleranced compensated state.

Step 4. Retract and Advance stage.

| | |
|---|---|
| A1 | *Vented |
| C1 | *Vented |
| C2 & C3 | *Air portion under gauging pressure |
| Valve A | *Actuated |
| Valve B | *Normal (non-actuated) |
| Valve C | *Closed, (actuated) |

Insertional pressure is blocked from entering the air portion of sealed chamber (C1) and the air portions of sealed chambers (C2) and (C3) are provided gauging pressure thereby causing them to retract. Hydraulic fluid from the hydraulic fluid portions of sealed chambers (C2) and (C3) is forced into the hydraulic fluid portion of sealed chamber (C1). While the first and second plungers (*7h*) and (*8h*) are retracted, the first toleranced length process element, (not shown), can be moved over second plunger (*8h*) and beneath the toleranced depth hole in the second process element, (not shown).

Step 5. Insertion.

| | |
|---|---|
| A1 | *Under gauging pressure |
| C1 | *Under insertional pressure |
| C2 & C3 | *Vented |
| Valve A | *Normal, (non-actuated) |
| Valve B | *Actuated |
| Valve C | Closed, (actuated) |

In this step insertional pressure is returned to the air portion of sealed chamber (C1) and the air portions of sealed chambers (C2) and (C3) are vented. This causes the upper end of first plunger (*7h*) to rise until it is flushly against the gauging surface, (not shown) against which the upper end of the first toleranced length process element contacted in Steps 2 and 3 above, and plunger (*8h*) to rise until the top end of the toleranced length first process element is precisely pushed into the toleranced depth hole in the second process element and meets the upper end of said toleranced hole with the intended gauging force, as controlled by the selecting of the gauging pressure by (R2). Gauging pressure is entered to the accumulator (A1) because of the action of valve (B), but serves no relevant purpose.

The system can then be reconfigured as indicated in Step 1 above for use in another assembly process.

Continuing, FIG. 11 shows the hydraulic embodiment of the present invention with an additional Toggle Means (TD2), which contains additional sealed chambers (C5) and (C6) in addition to a fourth plunger (*16h*) in sealed chamber (C4). An additional valve (D) is also present so that the hydraulic fluid circuit from the accumulator (A1) to Toggle Means (TD2) can be controlled independently from the hydraulic fluid circuit from Toggle Means (TD1) and the accumulator (A1). Note that both Toggle Means (TD1) and (TD2) are shown as operated from the same accumulator (A1). This is a cost saving convenience and is workable as long as the accumulator (A1) contains a sufficient amount of hydraulic fluid to supply all present Toggle Means. In addition, both can be operated from a single control system in an automated embodiment. It should also be appreciated that a multiplicity of such Toggle Means can likewise be operated from a single accumulator (A1) and control system, and that each Toggle Means can operate independently, and on greatly differing sizes of toleranced length first process elements and toleranced depth holes in second process elements. This is the case even when one or more of the toggles is not provided a process element.

Figure 12:
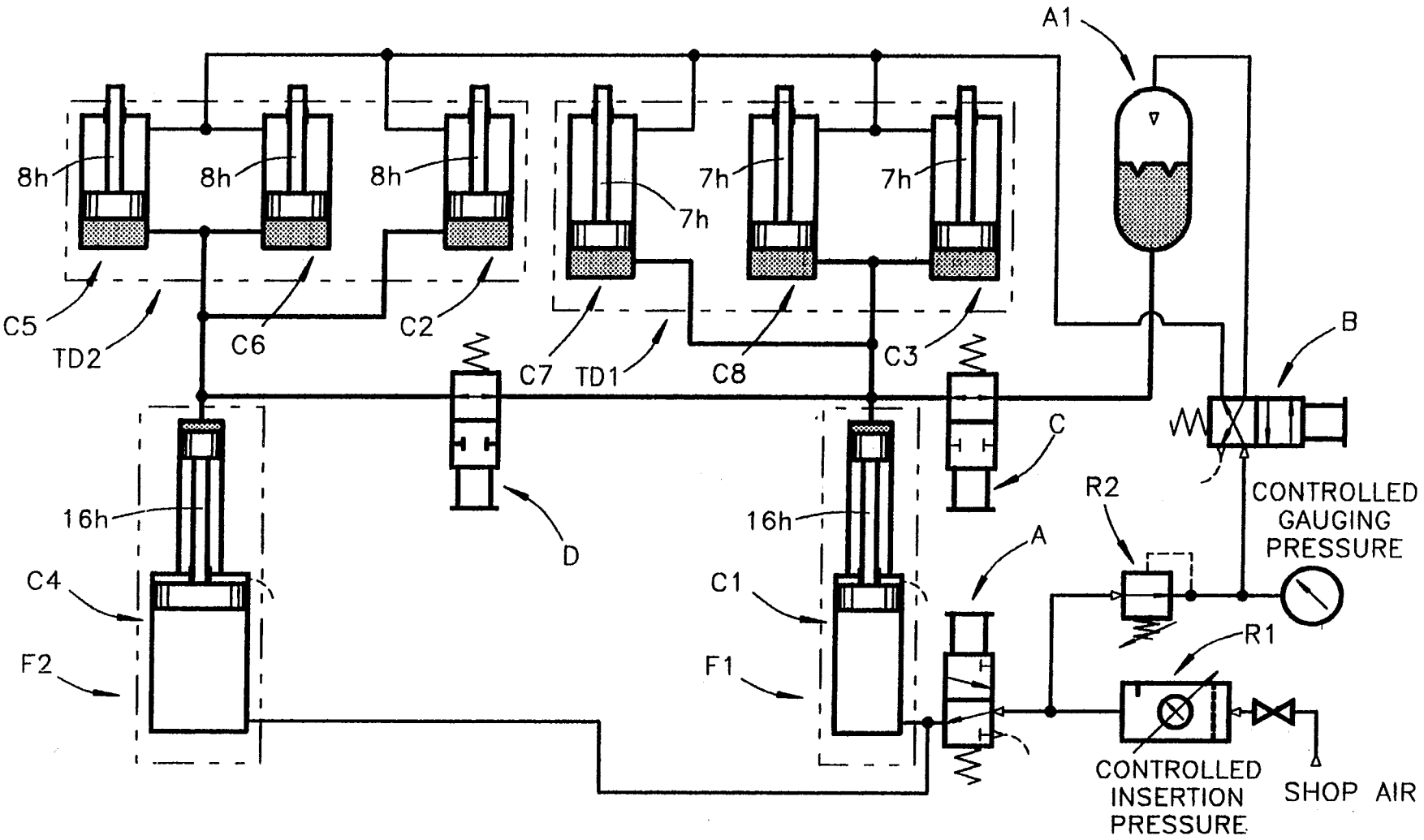
FIG. 12 shows a diagram as in FIG. 10 but in which the toggle means comprises a plurality or multiplicity of elements to aid in the assembly or positioning of non-coplanar process element.

It should also be understood that three plungers could be associated, on each side of a Toggle Means to allow handling of tolerance dimensioned planar objects which are to be inserted into tolerance dimensioned receptacles in second process elements, even when the surfaces of each are not coplanar. FIG. 12 demonstrates this embodiment.

It must also be understood that a plunger in a Toggle Means could be comprised of a drill or milling bit or any other processing tool. Such an embodiment would allow creating a hole of a desired depth in a second process element prior to inserting a toleranced length first process element thereinto. Said drilling or milling would be carried out while a system is configured as shown in FIG. *3b*, or an equivalent configuration for analogically functionally equivalent embodiments. This would allow not only gauging force adjustment, but also height reference precision.

It is also to be understood that in all embodiments the top of the second plunger (8) or (*8h*) can be utilized as a positioning means for positioning a toleranced length first process element to allow, for instance, the processing thereof. That is, the presence of a toleranced depth hole containing second process element is not necessary to the practice of the present invention. For instance, a toleranced length process element could be positioned with respect to a trimming laser beam to effect precise focal lengths etc. rather than in a toleranced depth hole in a second process element at a desired gauge force.

Figure 6:
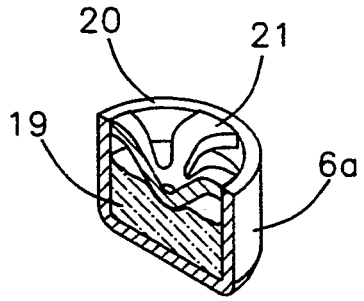
FIG. 6 shows a perspective cross section view of a primer for use in bullet shell casings.
Figure 7A:
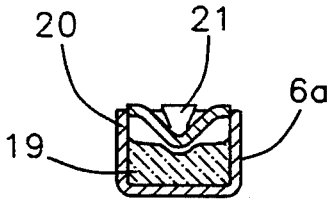
FIGS. 7*a* & 7*b* show front cross section elevational views of primers for use in bullet shell casings.
Figure 7B:
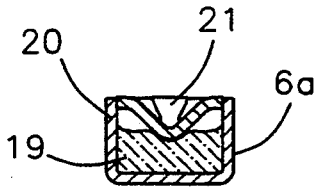
Figure 8:
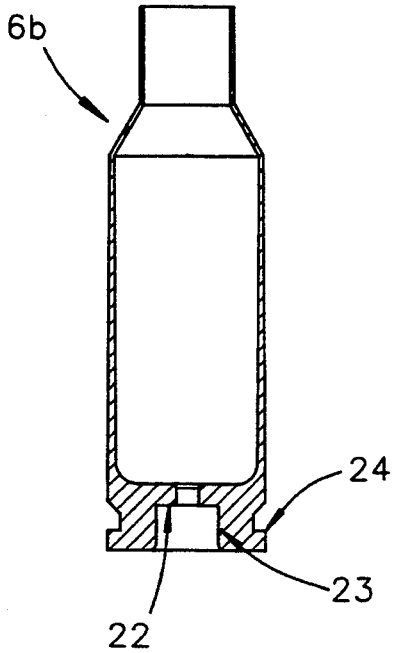
FIG. 8 shows a front cross section elevational view of a bullet shell casing typically used in centerfire cartridges.

While not a restriction as to use, a particularly relevant application of the present invention system and method of use is identified when the toleranced length first process element is a considered to be primer, and the second process element containing the toleranced depth hole is considered to be a bullet shell casing primer pocket. To make this demonstrative, (not limiting), application clear, FIG. 6 shows a perspective view of a typical primer (*6a*) and FIGS. *7a* and *7b* show front elevational views thereof. Note that a container (20) is shown with explosive compound (19) therein and with an anvil (21) atop thereof. FIG. 7*a* shows the lower end of the anvil (21) positioned above the explosive compound (19), and FIG. 7*b* shows the lower end of the anvil (19) precisely in abutted contact with said explosive compound. FIG. 7*a* represents a primer as purchased and FIG. 7*b* represents a primer which has been properly seated. Use of the present invention results in a properly seated primer as shown in FIG. 7*b*. FIG. 8 shows a front elevational view of a typical bullet shell casing (6*b*). Shown are a rim (24), the sides of a primer pocket (23) and the upper end (22) thereof. Use of the present invention results in a properly seated primer being inserted into the primer pocket with the upper end of the primer flushly abutted against the upper end of the primer pocket (22) at intended gauge force, to create the condition shown in FIG. 7*b*.

Finally, the system of the present invention was shown and described such that the Transfer Means was placed vertically above Toggle, Insertion and Tolerance Compensation Means throughout this Disclosure. It is to be understood that this was done for descriptional convenience. The system of the present invention can be operated in any functional orientation, including orientations in which the first and second plungers project other than vertically during use, and the claims are to be interpreted to include interpretation of any use of the terminology "vertical" or "horizontally oriented" etc. as demonstrative rather than limiting. In fact suction or magnetic etc. means might be present at the "upper" ends of one or a plurality or multiplicity of first and/or second plungers and said "upper" ends thereof be utilized oriented at a lower vertical level than said Toggle or Insertion Means. This might be particularly relevant where the system and method of the present invention are used to position the hood of a car for mounting to a body of a car, for instance. The claims, of course, are to be interpreted to cover and include the presence of more than one first or second plunger where a single first or second plunger is recited. Also, the insertion means shuttle bar was used as a demonstrative representation and not a limitation. Any functionally equivalent means, such as a rotary transfer table or a conveyor belt or a system in which the second process element is caused to move rather than the first etc. are to be considered within the scope of the claims under the generic terminology, "toleranced length first process element transfer means".

Having hereby disclosed the subject matter of this invention, it should be obvious that many modifications and substitutions and variations of the present invention are possible in light of the teachings. It is therefore to be understood that the invention may be practiced other than as specifically described, and should be limited in breadth and scope only by the claims.

I claim:

1. An assembly-positioning system for use in assembling tolerance dimensioned process elements into assembled tolerance dimensioned process element systems, and for use in positioning tolerance dimensioned first process elements for processing, which assembly-positioning system can simultaneously safely provide required insertion force and a desired gauging force between assembled tolerance dimensioned elements at a point of abutted contact therebetween; which assembly-positioning system does not require that process elements entered thereto for assembly be removed until assembly is complete; said assembly-positioning system comprising a toggle means comprising a first and a second plunger and means for causing the upper ends of said first and second plungers to raise or lower by application of forces to lower oriented aspects thereof, which forces are determined by other assembly-positioning system means which contact said first and second plungers at said lower oriented aspects thereof, which raising and lowering of said first and second plungers serve to first apply prestressing forces to compensate tolerances in said tolerance dimensioned process elements and in all assembly-positioning system elements and subsequently to insert a toleranced length first process element into a toleranced depth hole in a second tolerance dimensioned process element during use; the upper end of which second plunger serves during use to push a toleranced length first process element upward into a toleranced depth hole in a second tolerance dimensioned process element, after said first plunger serves to apply tolerance compensating prestressing force, developed by operation of said other assembly-positioning system means which contact said first and second plungers at said lower oriented aspects thereof, to a lower end of said tolerenced length first process element as an upper end thereof contacts a gauging surface in said assembly-positioning system, and as the upper end of said second plunger simultaneously applies tolerance compensation prestressing force to an upper end of said toleranced depth hole in said second tolerance dimensioned process element.

2. An assembly-positioning system as in claim 1 in which said toggle means further comprises an essentially horizontally oriented arm, the lower ends of said first and second plungers, when oriented so as to project vertically, rest upon opposite ends of said essentially horizontally oriented arm, said essentially horizontally oriented arm being pivotally connected at its midpoint to one end of an assembly-positioning system combination insertion means and tolerance compensation means such that the upper ends of said first and second plungers can be raised or lowered by the raising or lowering of the pivotal connection at the midpoint of said essentially horizontally oriented arm, and by rotation of the essentially horizontally oriented arm said pivotal connection.

3. An assembly-positioning system as in claim 1 in which said toggle means comprises a hydraulic system in which the lower ends of said first and second plungers are contacted by hydraulic fluid, said hydraulic fluid being contacted by combination insertion means and tolerance compensation means such that the upper ends of said first and second plungers can be caused to raise or lower by application of force to said insertion and tolerance compensation means.

4. A method of handling a toleranced length first process element comprising the steps of:

a. obtaining an assembly-positioning system for use in assembling tolerance dimensioned process elements into assembled tolerance dimensioned process element systems, and for use in positioning tolerance dimensioned first process elements for processing, which assembly-positioning system can simultaneously safely provide required insertion force and a desired gauging force between assembled tolerance dimensioned elements at a point of abutted contact therebetween; which assembly-positioning system does not require that process elements entered thereto for assembly be removed until assembly is complete; said assembly-positioning system comprising a toggle means comprising a first and a second plunger and means for causing the upper ends of said first and second plungers to raise or lower by application of forces to lower oriented aspects thereof, which forces are determined by other assembly-positioning system means which contact said first and second plungers at said lower oriented aspects thereof, which raising and lowering of said first and second plungers serve to first apply prestressing forces to compensate tolerances in said tolerance dimensioned process elements and in all assembly-positioning system elements and subsequently to insert a toleranced length first process element into a toleranced depth hole in a second tolerance dimensioned process element during use; the upper end of which second plunger serves, during use, to push a toleranced length first process element upward into a toleranced depth hole in a second tolerance dimensioned process element, after said first plunger serves to apply tolerance compensating prestressing force, developed by operation of said other assembly-positioning system means which contact said first and second plungers at said lower oriented aspects thereof, to a lower end of said toleranced length first process element as an upper end thereof contacts a gauging surface in said assembly-positioning system, and as the upper end of said second plunger simultaneously applies tolerance compensation prestressing force to an upper end of said toleranced depth hole in said second tolerance dimensioned process element;

b. entering a toleranced length first process element thereto and causing said toggle means to operate so that prestressing tolerance compensating force is first applied to said toleranced length first process element and said assembly-positioning system elements after which said toleranced length first process element is caused to be forced upward, both actions being caused by application of forces to lower oriented aspects of said first and second plungers by said other assembly-positioning system means.

5. An assembly-positioning system for use in assembling tolerance dimensioned process elements into assembled tolerance dimensioned process element systems, and for use in positioning first process elements for processing, which assembly-positioning system can simultaneously safely provide required insertion force and a desired gauging force between assembled tolerance dimensioned elements at a point of abutted contact therebetween; which assembly-positioning system does not require that tolerance dimensioned process elements entered thereto for assembly be removed until assembly is complete; said assembly-positioning system comprising a transfer means, a toggle means, an insertion means and a tolerance compensation means; which toggle means and tolerance compensation means operate in combination to provide complete compensation of all tolerances in a first toleranced length process element entered to said transfer means and tolerances in a toleranced depth hole in a second tolerance dimensioned process element into which said tolerance length first process element is caused to be inserted, and in all assembly-positioning system elements by application of toggle means applied prestressing forces to said tolerance dimensioned process elements, prior to toggle means effected insertion of said toleranced length first process element into said toleranced depth hole in said second tolerance dimensioned-process element; which prestressing forces are applied to said toggle means by said insertion and tolerance compensation means acting in combination and which transfer means serves to position said first toleranced length process element with respect to said toggle means for application of prestressing forces and for insertion into said toleranced depth hole in said second tolerance dimensioned process element during use.

6. An assembly-positioning system as in claim 5 in which the toggle means comprise first and second plungers and an essentially horizontally oriented arm, the lower ends of which first and second plungers viewed when oriented so as to project vertically, rest on opposite ends of said essentially horizontally oriented arm, said essentially horizontally oriented arm being pivotally connected at its midpoint to insertion means and tolerance compensation means such that the upper ends of said first and second plungers can be raised or lowered by the raising or lowering of said insertion means and/or tolerance compensation means, and by rotation of the essentially horizontally oriented arm about its pivotal connection with the upper end of said first link.

7. An assembly-positioning system as in claim 6 in which the insertion means comprise a first link and a second link, the raising or lowering of the upper end of said first link, which is pivotally connected to the midpoint of said essentially horizontally oriented arm, being effected by rotation of said second link about a pivotal connection with the upper end of said tolerance compensation means, the upper end of said second link being pivotally connected to the lower end of said first link; said raising or lowering of the upper end of said first link thus being effected by tolerance compensation means effected raising or lowering of the lower end of said second link; said pivotal connection of the lower end of said second link to the upper end of said tolerance compensation means providing a secured reference with respect to a rigid frame; said pivotal connection between the midpoint of the essentially horizontally oriented arm and the upper end of said first link and said pivotal connection between the lower end of said second link and the upper end of the tolerance compensation means being fixed so that any motion therebetween follows a vertically oriented locus; said insertion means being oriented with respect to said rigid frame such that said insertion means can thereby, during use, utilize the raising of the upper ends of said first and second plungers to safely, precisely, repeatably and consistently effect insertion of toleranced length first process elements into a toleranced depth holes in second tolerance dimensioned process elements so that an intended gauging force exists at their abutted point of contact.

8. An assembly-positioning system as in claim 5 in which the tolerance compensation means comprises gauging force determining applied force limiting means.

9. An assembly-positioning system as in claim 5 in which the toggle means comprise a hydraulic system which is filled with hydraulic fluid, which hydraulic fluid in said hydraulic system contacts the lower ends of said first and second plungers and which hydraulic fluid is accessed by insertion means and tolerance compensation means such that causing said insertion means and tolerance compensation means to apply force to said hydraulic fluid causes the raising of the upper ends of said first and second plungers; and in which said transfer means are structurally secured with respect to said first and second plungers, such that during use, the upward motion of the upper ends of said first and second plungers can be used to safely precisely, repeatably and consistently insert toleranced length first process elements into toleranced depth holes in second tolerance dimensioned process element so that an intended gauging pressure exists at their abutted point of contact.

10. An assembly-positioning system for use in assembling tolerance dimensioned process elements into assembled tolerance dimensioned process element systems, and for use in positioning first process elements for processing, which assembly-positioning system can simultaneously safely provide required insertion force and a desired gauging force between assembled tolerance dimensioned elements at a point of abutted contact therebetween; which assembly-positioning system does not require that process elements entered thereto for assembly be removed until assembly is complete; said assembly-positioning system comprising a transfer means, a toggle means, an insertion means and a tolerance compensation means; which toggle means and tolerance compensation means operate in combination to provide complete compensation of all tolerances in said tolerance dimensioned process elements and in all assembly-positioning system elements during use; which toggle means comprise first and second plungers, the lower ends of which first and second plungers viewed when oriented so as to project vertically, rest on opposite ends of an essentially horizontally oriented arm, said essentially horizontally oriented arm being pivotally connected at its midpoint to the upper end of insertion means first link such that the upper ends of said first and second plungers can be raised or lowered by the raising or lowering of the upper end of said first link, and by rotation of the essentially horizontally oriented arm about its pivotal connection with the upper end of said first link and which raising or lowering of the upper end of said first link is effected by rotation of an insertion means second link about a pivotal connection with the upper end of said tolerance compensation means, the upper end of said second link being pivotally connected to the lower end of said first link; said raising or lowering of the upper end of said first link thus being effected by tolerance compensation means effected raising or lowering of the lower end of said second link; said pivotal connection of the lower end of said second link to the upper end of said tolerance compensation means providing a secured reference with respect to a rigid frame; said pivotal connection between the midpoint of the essentially horizontally oriented arm and the upper end of said first link and said pivotal connection between the lower end of said second link and the upper end of the tolerance compensation means being fixed so that any motion therebetween follows a vertically oriented locus; said transfer means being oriented with respect to said rigid frame such that said insertion means can thereby, during use, utilize the raising of the upper ends of said first and second plunger toggle means to safely, precisely, repeatably and consistently effect insertion of toleranced length first process elements into toleranced depth holes in second tolerance dimensioned process elements so that an intended gauging force exists at their abutted point of contact.

11. An assembly-positioning system for assembling tolerance dimensioned process elements into assembled tolerance dimensioned process element systems, and for use in positioning first process elements for processing, which assembly-positioning system can simultaneously safely provide required insertion force and a desired gauging force between assembled tolerance dimensioned elements at a point of abutted contact therebetween; which assembly-positioning system does not require that process elements entered thereto for assembly be removed until assembly is complete; said assembly-positioning system comprising a transfer means, a toggle means, an insertion means and a tolerance compensation means; which toggle means and tolerance compensation means operate in combination to provide complete compensation of all tolerances in said tolerance dimensioned process elements and in all assembly-positioning system elements during use; which toggle means comprise first and second plungers and which toggle means further comprise a hydraulic system which is filled with hydraulic fluid, which hydraulic fluid in said hydraulic system contacts the lower ends of said first and second plungers and which hydraulic fluid is accessed by insertion means and tolerance compensation means such that causing said insertion means and/or tolerance compensation means to apply force to said hydraulic fluid causes the raising of the upper ends of said first and second plungers; and in which said transfer means are structurally secured with respect to said first and second plungers, such that during use, the upward motion of the upper ends of said first and second plungers can be used to safely precisely, repeatably and consistently insert toleranced length first process elements into toleranced depth holes in second tolerance dimensioned process elements so that an intended gauge pressure exists at their abutted point of contact.

12. An assembly-positioning system as in claim 10 in which the tolerance compensation means comprises gauging force determining applied force limiting means.

13. An assembly-positioning system as in claim 11 in which the tolerance compensation means comprises gauging force determining applied force limiting means.

14. An assembly-positioning system as in claim 1 in which the first and second plungers are oriented other than vertically during use.

15. An assembly-positioning system as in claim 6 in which the first and second plungers are oriented other than vertically during use.

16. An assembly-positioning system as in claim 10 in which the first and second plungers are oriented other than vertically during use.

17. An assembly-positioning system as in claim 11 in which the first and second plungers are oriented other than vertically.

18. An assembly-positioning system as in claim 10 in which the transfer means comprises a horizontally oriented channel means presenting with an upper gauging surface, which horizontally oriented channel means has a toleranced length first process element transfer means slidably mounted therein presenting with at least first and second vertically oriented holes therethrough; which transfer means further comprises first and second lower vertically oriented holes which enter said horizontally oriented channel means from below and first and second upper vertically oriented holes which enter said horizontally oriented channel means from above; said first and second plungers being within said first and second lower vertically oriented holes respectively; said first upper vertically oriented hole having toleranced length first process element entering means and said second upper vertically oriented hole having toleranced depth hole containing second process element securing means at the upper aspects thereof; such that said toleranced length first process element transfer means can be positioned in said horizontally oriented channel means so that a toleranced length first process element can be entered to said first vertically oriented hole therethrough and after prestressing said tolerance dimensioned process element, involving use of said toggle means, insertion means and tolerance compensating means, be safely, precisely, repeatably and consistently inserted into said toleranced depth hole in said second process element.

19. An assembly-positioning system as in claim 11 in which the transfer means comprises a horizontally oriented channel means presenting with an upper gauging surface, which horizontally oriented channel means has a toleranced length first process element transfer means slidably mounted therein presenting with at least first and second vertically oriented holes therethrough; which insertion means further comprises first and second lower vertically oriented holes which enter said horizontally oriented channel means from below and first and second upper vertically oriented holes which enter said horizontally oriented channel means from above; said first and second plungers being within said first and second lower vertically oriented holes respectively; said first upper vertically oriented hole having toleranced length first process element entering means and said second upper vertically oriented hole having toleranced depth hole containing second process element securing means at the upper aspects thereof; such that said toleranced length first process element transfer means can be positioned in said horizontally oriented channel means so that a toleranced length first process element can be entered to said first vertically oriented hole therethrough and after prestressing said tolerance dimensioned process element, involving use of said toggle means insertion means and tolerance compensating means, be safely, precisely, repeatably and consistently inserted into said toleranced depth hole in said second process element.

20. A method of handling a toleranced length first process element comprising the steps of:

a. obtaining an assembly-positioning system for use in assembling tolerance dimensioned process elements into assembled tolerance dimensioned process element systems, and for use in positioning first process elements for processing, which assembly-positioning system can simultaneously safely provide required insertion force and a desired gauging force between assembled tolerance dimensioned elements at a point of abutted contact therebetween; which assembly-positioning system does not require that process elements entered thereto for assembly be removed until assembly is complete; said assembly-positioning system comprising a transfer means, a toggle means, an insertion means and a tolerance compensation means; which toggle means and tolerance compensation means operate in combination to provide complete compensation of all tolerances in said tolerance dimensioned process elements and in all assembly-positioning system elements during use; which toggle means comprise first and second plungers, the lower ends of which first and second plungers viewed when oriented so as to project vertically, rest on opposite ends of an essentially horizontally oriented arm, said essentially horizontally oriented arm being pivotally connected at its midpoint to the upper end of an insertion means first link such that the upper ends of said first and second plungers can be raised or lowered by the raising or lowering of the upper end of said first link, and by rotation of the essentially horizontally oriented arm about its pivotal connection with the upper end of said first link and which raising or lowering of the upper end of said first link is effected by rotation of an insertion means second link about a pivotal connection with the upper end of said tolerance compensation means, the upper end of said second link being pivotally connected to the lower end of said first link; said raising or lowering of the upper end of said first link thus being effected by tolerance compensation means effected raising or lowering of the lower end of said second link; said pivotal connection of the lower end of said second link to the upper end of said tolerance compensation means providing a secured reference with respect to a rigid frame; said pivotal connection between the midpoint of the essentially horizontally oriented arm and the upper end of said first link and said pivotal connection between the lower end of said second link and the upper end of the tolerance compensation means being fixed so that any motion therebetween follows a vertically oriented locus; said transfer means being oriented with respect to said rigid frame such that said transfer means can thereby, during use, utilize the raising of the upper ends of said first and second plungers to safely, precisely, repeatably and consistently effect insertion of toleranced length first process elements into toleranced depth holes in second process elements so that an intended gauging force exists at their abutted point of contact; said transfer means comprising a horizontally oriented channel means presenting with an upper gauging surface, which horizontally oriented channel means has a toleranced length first process element transfer means slidably mounted therein presenting with at least first and second vertically oriented holes therethrough; which insertion means further comprises first and second lower vertically oriented holes which enter said horizontally oriented channel means from below and first and second upper vertically oriented holes which enter said horizontally oriented channel means from above; said first and second plungers being within said first and second lower vertically oriented holes respectively; said first upper vertically oriented hole having toleranced length first process element entering means and said second upper vertically oriented hole having toleranced depth hole containing second process element securing means at the upper aspects thereof; such that said toleranced length first process element transfer means can be positioned in said horizontally oriented channel means so that a toleranced length first process element can be entered to said first vertically oriented hole therethrough and by operation of said toggle means, insertion means and tolerance compensating means, be safely, precisely, repeatably and consistently inserted into said toleranced depth hole in said second process element;

b. operating said insertion means and tolerance compensation means to position the upper ends of said first and second plungers below said horizontally oriented channel means;

c. sliding said toleranced length first process element transfer means so that the first vertically oriented hole therethrough is positioned beneath said first upper vertically oriented hole which enters said horizontally oriented channel means from above and entering a toleranced length first process element into said toleranced length first process element transfer means first vertically oriented hole;

d. sliding said toleranced length first process element transfer means so that said toleranced length first process element in said first vertically oriented hole through said toleranced length first process element transfer means is positioned directly above said first lower vertically oriented hole in which is present said first plunger, and so said second vertically oriented hole through said toleranced length first process element transfer means is simultaneously positioned above said second lower vertically oriented hole in which is present said second plunger and also below said second upper vertically oriented hole which enters said horizontally oriented channel means from above;

e. placing a toleranced depth hole containing second process element in securing means above said second upper vertically oriented hole which enters said horizontally oriented channel means from above;

f. operating said insertion and tolerance compensating means so that said toleranced length first process element is sandwiched between the upper end of said first plunger and the upper gauging surface of said horizontally oriented channel means and so that the upper end of said second plunger simultaneously flushly contacts the vertically upper end of said toleranced depth hole in said second process element such that a gauging force between the upper end of said toleranced length first process element and said upper gauge surface of said horizontally oriented channel means is set by adjustment of said tolerance compensation means;

g. operating said insertion means to lower the upper ends of said first and second plungers so that said toleranced length first process element transfer means is free to slide in said horizontally oriented channel means, and sliding said toleranced length first process element transfer means so that said toleranced length first process element in said first vertically oriented hole through said toleranced length first process element transfer means is positioned directly above said second lower vertically oriented hole in which is present said second plunger and directly below said second upper vertically oriented hole which enters said horizontally oriented channel means from above;

h. optionally removing said second process element; and i. operating said insertion means to raise the upper ends of said first and second plungers so that the upper end of said first plunger is positioned flushly against the upper gauging surface of said horizontally oriented channel means and so that said toleranced length first process element is inserted into the toleranced depth hole in said second process element by the upper end of said second plunger so that the upper end of said toleranced length first process element and the vertically upper end of said toleranced depth hole in said second process element are abutted together with said intended gauging force therebetween, assuming said second process element is present, and so that said toleranced length first process element is positioned atop the upper end of said second plunger for processing if said second process element was removed in step h.

21. A method of handling a toleranced length first process element comprising the steps of:

a. obtaining an assembly-positioning system for use in assembling tolerance dimensioned process elements into assembled tolerance dimensioned process element systems, and for use in positioning first process elements for processing, which assembly-positioning system can simultaneously safely provide required insertion force and a desired gauging force between assembled tolerance dimensioned elements at a point of abutted contact therebetween; which assembly-positioning system does not require that process elements entered thereto for assembly be removed until assembly is complete; said assembly-positioning system comprising a transfer means, a toggle means, an insertion means and a tolerance compensation means; which toggle means and tolerance compensation means operate in combination to provide complete compensation of all tolerances in said tolerance dimensioned process elements and in all assembly-positioning system elements during use; which toggle means comprise first and second plungers and which toggle means further comprise a hydraulic system which is filled with hydraulic fluid, which hydraulic fluid in said hydraulic system contacts the lower ends of said first and second plungers and which hydraulic fluid is accessed by insertion means and tolerance compensation means such that causing said insertion means and tolerance compensation means to apply force to said hydraulic fluid causes the raising of the upper ends of said first and second plungers; and in which said transfer means are structurally secured with respect to said first and second plungers, such that during use, the upward motion of the upper ends of said first and second plungers can be used to safely precisely, repeatably and consistently insert toleranced length first process elements into toleranced depth holes in second process elements so that an intended gauging force exists at their abutted point of contact; said transfer means comprising a horizontally oriented channel means presenting with an upper gauging surface, which horizontally oriented channel means has a toleranced length first process element transfer means slidably mounted therein presenting with at least first and second vertically oriented holes therethrough; which transfer means further comprises first and second lower vertically oriented holes which enter said horizontally oriented channel means from below and first and second upper vertically oriented holes which enter said horizontally oriented channel means from above; said first and second plungers being within said first and second lower vertically oriented holes respectively; said first upper vertically oriented hole having toleranced length first process element entering means and said second upper vertically oriented hole having toleranced depth hole containing second process element securing means at the upper aspects thereof; such that said toleranced length first process element transfer means can be positioned in said horizontally oriented channel means so that a toleranced length first process element can be entered to said first vertically oriented hole therethrough and by operation of said insertion means and tolerance compensating means, be safely, precisely, repeatably and consistently inserted into said toleranced depth hole in said second process element;

b. operating said insertion means and tolerance compensation means to position the upper ends of said first and second plungers below said horizontally oriented channel means;

c. sliding said toleranced length first process element transfer means so that the first vertically oriented hole therethrough is positioned beneath said first upper vertically oriented hole which enters said horizontally oriented channel means from above and entering a toleranced length first process element into said toleranced length first process element transfer means first vertically oriented hole;

d. sliding said toleranced length first process element transfer means so that said toleranced length first process element in said first vertically oriented hole through said toleranced length first process element transfer means is positioned directly above said first lower vertically oriented hole in which is present said first plunger, and so said second vertically oriented hole through said toleranced length first process element transfer means is simultaneously positioned above said second lower vertically oriented hole in which is present said second plunger and also below said second upper vertically oriented hole which enters said horizontally oriented channel means from above;

e. placing a toleranced depth hole containing second process element in securing means above said second upper vertically oriented hole which enters said horizontally oriented channel means from above;

f. operating said insertion and tolerance compensating means so that said toleranced length first process element is sandwiched between the upper end of said first plunger and the upper gauging surface of said horizontally oriented channel means and so that the upper end of said second plunger simultaneously flushly contacts the vertically upper end of said toleranced depth hole in said second process element such that a gauging force between the upper end of said toleranced length first process element and said upper gauge surface of said horizontally oriented channel means is set by adjustment of said tolerance compensation means;

g. operating said insertion means to lower the upper ends of said first and second plungers so that said toleranced length first process element transfer means is free to slide in said horizontally oriented channel means, and sliding said toleranced length first process element transfer means so that said toleranced length first process element in said first vertically oriented hole through said toleranced length first process element transfer means is positioned directly above said second lower vertically oriented hole in which is present said second plunger and directly below said second upper vertically oriented hole which enters said horizontally oriented channel means from above;

h. optionally removing said second process element; and i. operating said insertion means to raise the upper ends of said first and second plungers so that the upper end of said first plunger is positioned flushly against the upper gauging surface of said horizontally oriented channel means and so that said toleranced length first process element is inserted into the toleranced depth hole in said second process element by the upper end of said second plunger so that the upper end of said toleranced length first process element and the vertically upper end of said toleranced depth hole in said second process element are abutted together with said intended gauging force therebetween, assuming said second process element is present, and so that said toleranced length first process element is positioned atop the upper end of said second plunger for processing if said second process element was removed in step h.

22. An assembly-positioning system as in claim 1 in which the upper end of said second plunger is a means for processing a process element.

23. An assembly-positioning system as in claim 6 in which the upper end of said second plunger is a means for processing a process element.

24. An assembly-positioning system as in claim 10 in which the upper end of said second plunger is a means for processing a process element.

25. An assembly-positioning system as in claim 11 in which the upper end of said second plunger is a means for processing a process element.

26. An assembly-positioning system as in claim 3 in which the insertion means for applying force comprise a means for adding and deleting hydraulic fluid to said hydraulic system through a means separate from that which controls tolerance compensation force.

27. An assembly-positioning system as in claim 3 in which the tolerance compensation means for applying force comprise a means for adding and deleting hydraulic fluid to said hydraulic system through a means separate from that which controls insertional force.

28. An assembly-positioning system as in claim 9 in which the insertion and tolerance compensation means for applying force comprise a means for adding and deleting hydraulic fluid to said hydraulic system.

29. An assembly-positioning system as in claim 11 in which the insertion and tolerance compensation means for applying force comprise a means for adding and deleting hydraulic fluid to said hydraulic system.

30. An assembly-positioning system for use in assembling tolerance dimensioned process elements into assembled tolerance dimensioned process element systems, and for use in positioning tolerance dimensioned first process elements for processing, which assembly-positioning system can simultaneously safely provide required insertion force and a desired gauging force between assembled tolerance dimensioned elements at a point of abutted contact therebetween; which assembly-positioning system does not require that process elements entered thereto for assembly be removed until assembly is complete; said assembly-positioning system comprising a toggle means comprising a first and a second plunger and means for causing the upper ends of said first and second plungers to raise or lower by application of forces to lower oriented aspects thereof, which forces are determined by other assembly-positioning system means which contact said first and second plungers at said lower oriented aspects thereof, which raising and lowering of said first and second plungers serve to first apply prestressing forces to compensate tolerances in said tolerance dimensioned process elements and in all assembly-positioning system elements and subsequently to position a toleranced length first process element for processing, during use; the upper end of which second plunger serves, during use, to push a toleranced length first process element upward into position for processing after said first plunger serves to apply tolerance compensating prestressing force, developed by operation of said other assembly-positioning system means which contact said first and second plungers at said lower oriented aspects thereof, to a lower end of said toleranced length first process element as an upper end thereof contacts a gauging surface in said assembly-positioning system, and as the upper end of said second plunger simultaneously applies tolerance compensation prestressing force to a barrier positioned thereabove.

* * * * *